US010018388B2

(12) United States Patent
Takenaka et al.

(10) Patent No.: US 10,018,388 B2
(45) Date of Patent: Jul. 10, 2018

(54) HEAT SOURCE SIDE UNIT AND REFRIGERATION CYCLE APPARATUS

(71) Applicant: MITSUBISHI ELECTRIC CORPORATION, Chiyoda-ku (JP)

(72) Inventors: Naofumi Takenaka, Chiyoda-ku (JP); Shinichi Wakamoto, Chiyoda-ku (JP); Kazuya Watanabe, Chiyoda-ku (JP); Koji Yamashita, Chiyoda-ku (JP); Takeshi Hatomura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/120,819

(22) PCT Filed: Sep. 5, 2014

(86) PCT No.: PCT/JP2014/073500
§ 371 (c)(1),
(2) Date: Aug. 23, 2016

(87) PCT Pub. No.: WO2015/129080
PCT Pub. Date: Sep. 3, 2015

(65) Prior Publication Data

US 2016/0370045 A1 Dec. 22, 2016

(30) Foreign Application Priority Data

Feb. 27, 2014 (JP) ..... 2014-037255

(51) Int. Cl.
*F25B 47/02* (2006.01)
*F25B 13/00* (2006.01)
*F28D 1/04* (2006.01)

(52) U.S. Cl.
CPC ..... *F25B 47/022* (2013.01); *F25B 13/00* (2013.01); *F25B 47/02* (2013.01); *F28D 1/0443* (2013.01);
(Continued)

(58) Field of Classification Search
CPC ..... F25B 13/00; F25B 47/02; F25B 47/022; F25B 2313/0251; F25B 2313/0253;
(Continued)

(56) References Cited

U.S. PATENT DOCUMENTS 5,158,506 A * 10/1992 Kusano ..... A23G 9/163 62/136
2011/0232308 A1 9/2011 Morimoto et al.
2013/0098092 A1 4/2013 Wakamoto et al.

FOREIGN PATENT DOCUMENTS

CN 102272534 A 12/2011
JP 4-143564 A 5/1992
(Continued)

OTHER PUBLICATIONS

International Search Report dated Dec. 9, 2014, in PCT/JP2014/073500 filed Sep. 5, 2014.
(Continued)

*Primary Examiner* — Marc Norman
(74) *Attorney, Agent, or Firm* — Oblon, McClelland, Maier & Neustadt, L.L.P.

(57) ABSTRACT

An outdoor unit, connected with indoor units by pipes to constitute a refrigerant circuit, includes a compressor configured to compress and discharge refrigerant, a plurality of parallel heat exchangers configured to allow heat exchange between air and the refrigerant, a first defrosting pipe serving as a flow path for branching a part of the refrigerant discharged by the compressor and allowing the refrigerant to flow into the parallel heat exchanger to be defrosted for
(Continued)

defrosting, a first expansion device configured to decompress the refrigerant passing through the first defrosting pipe, a second expansion device configured to adjust the pressure of the refrigerant that passed through the parallel heat exchanger to be defrosted, and a controller configured to control the second expansion device such that the pressure of the refrigerant that passed through the parallel heat exchanger to be defrosted falls within a predetermined range.

5 Claims, 14 Drawing Sheets

(52) U.S. Cl.
CPC ..... *F25B 2313/0233* (2013.01); *F25B 2313/0251* (2013.01); *F25B 2313/0253* (2013.01); *F25B 2313/0315* (2013.01); *F25B 2341/0661* (2013.01); *F25B 2600/2513* (2013.01)

(58) Field of Classification Search
CPC .... F25B 2313/02532; F25B 2313/0233; F25B 2313/0315; F25B 2341/0661; F25B 2600/2513
See application file for complete search history.

(56) References Cited

FOREIGN PATENT DOCUMENTS

| | | | |
|---|---|---|---|
| JP | 7-120116 | A | 5/1995 |
| JP | 8-100969 | A | 4/1996 |
| JP | 2006-162240 | A | 6/2006 |
| JP | 2011-75207 | A | 4/2011 |
| JP | 2011-102678 | A | 5/2011 |
| JP | 2011-158144 | A | 8/2011 |
| WO | WO 2010/082325 | A1 | 7/2010 |
| WO | WO 2011/093080 | A1 | 8/2011 |
| WO | WO 2012/014345 | A1 | 2/2012 |
| WO | 2013-36682 | A | 2/2013 |
| WO | WO 2014/020651 | A1 | 2/2014 |

OTHER PUBLICATIONS

Japanese Office Action dated Mar. 29, 2016, in Japanese Patent Application 2015-522312 (with English translation).
European Office Action dated Oct. 4, 2017 in European Patent Appiication No. 14884235.4.
Extended European Search Report dated Jan. 26, 2018 in European Patent Application No. 14884235.4, 7 pages.
Combined Chinese Office Action and Search Report dated Feb. 5, 2018 in Chinese Patent Application No. 201480076405.1 (with English translation and English translation of Category of Cited Documents), citing documents AO and AP therein, 19 pages.

* cited by examiner

FIG. 3

| VALVE NO. | COOLING | HEATING | | |
|---|---|---|---|---|
| | | NORMAL OPERATION | CONTINUOUS HEATING | |
| | | | 50-1: EVAPORATOR<br>50-2: DEFROSTING | 50-1: DEFROSTING<br>50-2: EVAPORATOR |
| 2 | OFF | ON | ON | ON |
| 4-b, 4-c | INDOOR UNIT OUTLET REFRIGERANT SUPERHEAT | INDOOR UNIT OUTLET REFRIGERANT SUBCOOLING | INDOOR UNIT OUTLET REFRIGERANT SUBCOOLING | INDOOR UNIT OUTLET REFRIGERANT SUBCOOLING |
| 7-1 | FULL OPEN | FULL OPEN | FULL OPEN | DEFROSTING HEAT EXCHANGE PRESSURE |
| 7-2 | FULL OPEN | FULL OPEN | DEFROSTING HEAT EXCHANGE PRESSURE | FULL OPEN |
| 8-1 | ON | ON | ON | OFF |
| 8-2 | ON | ON | OFF | ON |
| 9-1 | OFF | OFF | OFF | ON |
| 9-2 | OFF | OFF | ON | OFF |
| 10 | CLOSE | CLOSE | OPENING DEGREE FIXED | OPENING DEGREE FIXED |

FIG. 22

| VALVE NO. | COOLING | HEATING | | |
|---|---|---|---|---|
| | | NORMAL OPERATION | CONTINUOUS HEATING | |
| | | | 50-1: EVAPORATOR 50-2: DEFROSTING | 50-1: DEFROSTING 50-2: EVAPORATOR |
| 2 | OFF | ON | ON | ON |
| 4-b, 4-c | INDOOR UNIT OUTLET REFRIGERANT SUPERHEAT | INDOOR UNIT OUTLET REFRIGERANT SUBCOOLING | INDOOR UNIT OUTLET REFRIGERANT SUBCOOLING | INDOOR UNIT OUTLET REFRIGERANT SUBCOOLING |
| 7-1 | FULL OPEN | FULL OPEN | MEDIUM PRESSURE | CLOSE |
| 7-2 | FULL OPEN | FULL OPEN | CLOSE | MEDIUM PRESSURE |
| 7-3 | CLOSE | CLOSE | DEFROSTING HEAT EXCHANGE PRESSURE | DEFROSTING HEAT EXCHANGE PRESSURE |
| 8-1 | ON | ON | ON | OFF |
| 8-2 | ON | ON | OFF | ON |
| 9-1 | OFF | OFF | OFF | ON |
| 9-2 | OFF | OFF | ON | OFF |
| 10 | CLOSE | CLOSE | OPENING DEGREE FIXED | OPENING DEGREE FIXED |
| 17 | CLOSE | CLOSE | DISCHARGE TEMPERATURE (DISCHARGE SUPERHEAT) | DISCHARGE TEMPERATURE (DISCHARGE SUPERHEAT) |
| 18-1 | OFF | OFF | OFF | ON |
| 18-2 | OFF | OFF | ON | OFF |

HEAT SOURCE SIDE UNIT AND REFRIGERATION CYCLE APPARATUS

TECHNICAL FIELD

The present invention relates to a heat source side unit and other units in a refrigeration cycle apparatus such as an air-conditioning apparatus.

BACKGROUND ART

In recent years, from a viewpoint of global environmental protection, cases of introducing heat pump type air-conditioning apparatuses, using the air as a heat source, are increasing even in cold areas, in place of boiler type heating devices in which heating is performed by burning fossil fuel. In a heat pump type air-conditioning apparatus, heating can be performed more efficiently by the amount of heat supplied from the air in addition to the electricity input to the compressor.

On the other hand, however, in a heat pump type air-conditioning apparatus, when the temperature of the air outside the room (outside air) (outside air temperature) is decreasing, an outdoor heat exchanger, functioning as an evaporator to allow heat exchange between the outside air and refrigerant, is more likely to be frosted. Accordingly, it is necessary to perform defrosting to melt the frost deposited on the outdoor heat exchanger. As a method of performing defrosting, there is a method of reversing the flow of refrigerant in heating to supply the refrigerant from the compressor to the outdoor heat exchanger, for example. However, in this method, as defrosting is performed while stopping heating in the room in some cases, there is a problem that comfortability is impaired.

As such, to allow heating even during defrosting, a method has been proposed in which an outdoor heat exchanger is divided for example, and when a part of the outdoor heat exchanger performs defrosting, the other part of the outdoor heat exchanger functions as an evaporator to remove heat from the outside air to perform heating (see Patent Literature 1, Patent Literature 2, and Patent Literature 3, for example).

For example, in the technique described in Patent Literature 1, an outdoor heat exchanger is divided into two heat exchanger units. Then, in the case of defrosting one heat exchanger unit, an electronic expansion valve provided upstream of the heat exchange unit to be defrosted is closed. Further, by opening a solenoid valve of a bypass pipe for allowing refrigerant to bypass from a discharge pipe of the compressor to the inlet of the heat exchanger unit, a part of the high-temperature refrigerant discharged from the compressor is allowed to directly flow into the heat exchanger unit to be defrosted. Then, upon completion of defrosting of one heat exchanger unit, defrosting is performed on the other heat exchanger unit. At this time, in the heat exchanger unit to be defrosted, defrosting is performed in a state where the refrigerant therein is in a low-pressure state equivalent to the suction pressure of the compressor (low-pressure defrosting).

Further, in the technique described in Patent Literature 2, a plurality of heat source units and at least one indoor unit are provided. Then, in only a heat source unit provided with a heat source side heat exchanger to be defrosted, the connecting state of a four-way valve is reversed from the state at the time of heating, and the refrigerant discharged from the compressor is allowed to directly flow into the heat exchanger on the heat source unit side. At this time, in the heat exchanger on the heat source unit side to be defrosted, defrosting is performed in a state where the refrigerant therein is in a high-pressure state equivalent to the discharge pressure of the compressor (high-pressure defrosting).

Further, in the technique described in Patent Literature 3, an outdoor heat exchanger is divided into a plurality of outdoor heat exchangers, and a part of the high-temperature refrigerant discharged from the compressor is allowed to flow into the respective outdoor heat exchangers by turns, and defrosting is performed on the respective outdoor heat exchangers by turns. As such, heating can be performed continuously in the apparatus as a whole. Further, the compressor includes an injection port, and the refrigerant supplied to the outdoor heat exchanger to be defrosted is injected from the injection port into the compressor. At this time, in the outdoor heat exchanger to be defrosted, defrosting is performed in a state where the pressure of the refrigerant therein is lower than the discharge pressure of the compressor and higher than the suction pressure (pressure that becomes a temperature slightly higher than 0 degrees C. on a saturation temperature conversion basis) (medium-pressure defrosting). Among the three types of defrosting methods, Patent Literature 3 describes that defrosting can be performed more efficiently by medium-pressure defrosting, compared with the other methods.

Further, in the techniques described in Patent Literature 1 and Patent Literature 3, defrosting is terminated after it is performed for a certain period of time. Further, defrosting is terminated when the temperature of a temperature sensor, provided on the refrigerant outflow side of the heat exchanger to be defrosted, exceeds a predetermined temperature. In the technique described in Patent Literature 2, an expansion device controls the degree of subcooling (subcooling) on the refrigerant outflow side of the heat source side heat exchanger to be defrosted. It is configured that defrosting is terminated when it is determined that the opening degree of the expansion device becomes a predetermined opening degree or less.

CITATION LIST

Patent Literature

Patent Literature 1: Japanese Unexamined Patent Application Publication No. 2011-075207 (paragraphs [0042]-[0050], FIG. 6)

Patent Literature 2: Japanese Unexamined Patent Application Publication No. 08-100969 (paragraphs [0016]-[0024], FIG. 1)

Patent Literature 3: International Publication No. 2012/014345 (paragraph [0006], FIG. 1)

SUMMARY OF INVENTION

Technical Problem

For example, in the medium-pressure defrosting described in Patent Literature 3, the pressure of a heat exchanger to be defrosted is controlled to be within a predetermined range to perform defrosting of the heat exchanger efficiently with a small refrigerant flow rate, whereby high heating capability can be achieved on the indoor unit side. At this time, when defrosting is terminated based on time, determination of whether or not the frost melted completely (defrosting is completed) is not performed. This causes problems that energy and time for defrosting are wasted, heating capability of heating operation after restoration is lowered significantly due to an effect of the remaining frost, and the like.

Further, as pressure of a heat exchanger to be defrosted is controlled, a rise in the pipe temperature on the refrigerant outflow side of the heat exchanger when the frost melted completely is small, unlike conventional reverse defrosting, low-pressure defrosting, and the like. As such, it is difficult to determine completion of defrosting based on the temperature of the refrigerant outlet pipe of the heat exchanger as in Patent Literature 1 and Patent Literature 3. Further, by applying control of refrigerant at the outlet of the heat exchanger to be defrosted to medium-pressure defrosting as in the case of high-pressure defrosting in Patent Literature 2, a medium pressure may deviate from an optimum control range.

In view of the above, the present invention has been made to solve the above-described problems. An object of the present invention is to provide a heat source side unit and the like in which defrosting of a heat exchanger can be performed efficiently while heating of a load (heating of an indoor unit and the like) is continued, for example.

Solution to Problem

A heat source side unit of the present invention is a heat source side unit connected with a use side unit by pipes to constitute a refrigerant circuit. The heat source side unit includes a compressor configured to compress and discharge refrigerant; a plurality of heat source side heat exchangers configured to allow heat exchange between the air and the refrigerant; a first defrosting pipe serving as a flow path for branching a part of the refrigerant discharged by the compressor and allowing the refrigerant to flow into the heat source side heat exchanger to be defrosted for defrosting; a first expansion device configured to decompress the refrigerant passing through the first defrosting pipe; a second expansion device configured to adjust the pressure of the refrigerant that passed through the heat source side heat exchanger to be defrosted; and a controller configured to control the second expansion device such that the pressure of the refrigerant that passed through the heat source side heat exchanger to be defrosted falls within a predetermined range, and perform defrosting completion determination based on the degree of subcooling of the refrigerant passing through the heat source side heat exchanger to be defrosted.

Advantageous Effects of Invention

According to the present invention, it is possible to efficiently defrost a heat source side heat exchanger to be defrosted, while keeping heating of a load like heating of a space to be air-conditioned. Further, it is possible to determine completion of defrosting with high accuracy, and to restore a defrosted outdoor side heat exchanger as an evaporator quickly.

BRIEF DESCRIPTION OF DRAWINGS

FIG. 3 is a diagram showing ON/OFF states of respective valves and states of opening degree adjusting control in respective operating modes of the air-conditioning apparatus 100 according to Embodiment 1 of the present invention.

FIG. 22 is a diagram showing ON/OFF states of respective valves and states of opening degree adjusting control in respective operating modes of the air-conditioning apparatus 100 according to Embodiment 2 of the present invention.

DESCRIPTION OF EMBODIMENTS

Figure 1:
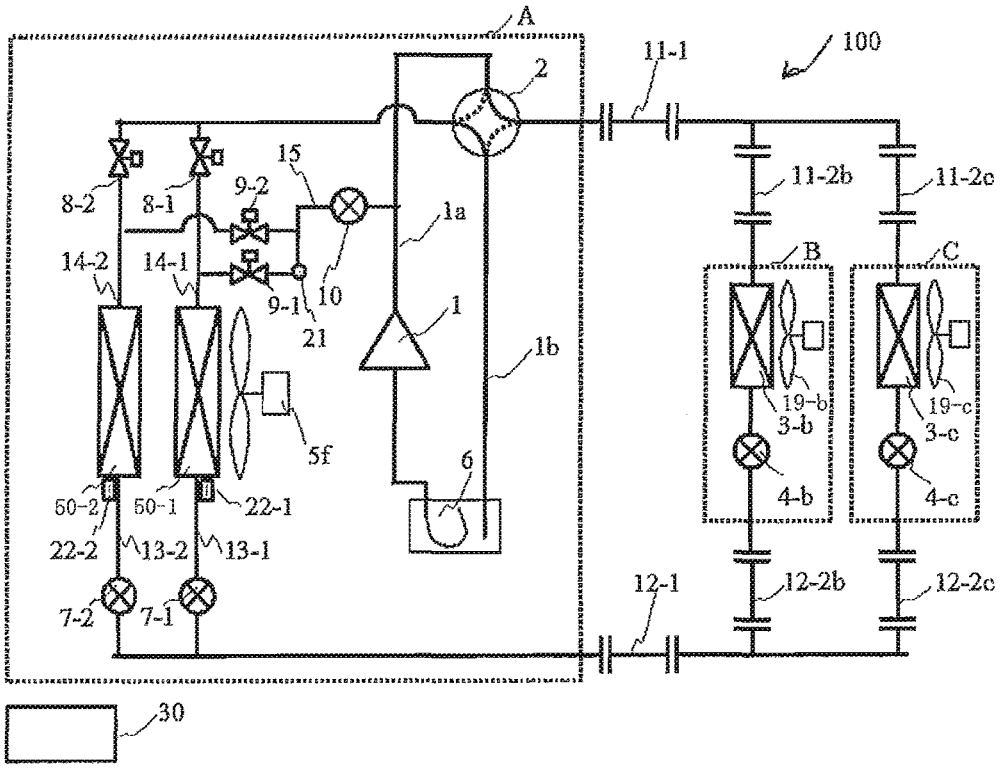
FIG. 1 is a diagram showing a configuration of an air-conditioning apparatus 100 having a heat source side unit according to Embodiment 1 of the present invention.

Hereinafter, an air-conditioning apparatus according to an embodiment will be described with reference to the drawings and the like. In the drawings described below including FIG. 1, those denoted by the same reference numerals or reference characters are identical or equivalent thereto, which applies to the entire description of the embodiments provided below. Further, the modes of the constituent elements described in the entire description are provided for illustrative purposes, and are not limited to the forms described in the description. In particular, combinations of constituent elements, determination for control, and the like are not limited to the combinations described in the respective embodiments. Constituent elements described in one embodiment may be applied to another embodiment. Further, regarding a plurality of devices of the same type distinguished by applying subscripts or branch numbers, when it is not necessary to distinguish or specify the devices particularly, subscripts or the like may be omitted. Further, in the drawings, a magnitude relationship between the respective constituent members may be different from the actual ones. Furthermore, regarding high and low of temperature, pressure, and the like, high, low, and the like are not defined in a relationship with absolute values particularly. They are defined relatively according to the states, operation, and the like in the system, apparatuses, and the like.

Embodiment 1

FIG. 1 is a diagram showing a configuration of an air-conditioning apparatus 100 having a heat source side unit according to Embodiment 1 of the present invention. The air-conditioning apparatus 100 of Embodiment 1 includes an outdoor unit A serving as a heat source side unit, and a plurality of indoor units (use side units) B and C connected in parallel with each other. The outdoor unit A and the indoor units B and C are connected via first extension pipes 11-1 and 11-2*b* and 11-2*c*, and second extension pipes 12-1 and 12-2*b* and 12-2*c*, which constitute a refrigerant circuit. The air-conditioning apparatus 100 also includes a controller 30. The controller 30 controls a cooling operation or a heating operation (a heating normal operation or a heating defrosting operation) of the indoor units B and C. In this example, the controller 30 of Embodiment 1 is configured of a microcomputer or another device having a control arithmetic processing unit such as a Central Processing Unit (CPU). The controller 30 also includes a storage unit (not shown), having data of processing procedures according to control and the like as a program. Then, the control arithmetic processing unit executes processing based on the data of the program to realize control.

In this example, as refrigerant to be circulated in the refrigerant circuit, fluorocarbon refrigerants, HFO refrigerants, or other refrigerants may be used, for example. Fluorocarbon refrigerants include R32, R125, R134a, and other refrigerants of HFC refrigerants, for example. They also include R410A, R407c, R404A and other refrigerants that are mixed refrigerants of HFC refrigerants. Further, HFO refrigerants include HFO-1234yf, HFO-1234ze(E), HFO-1234ze(Z), and other refrigerants, for example. Further, as other refrigerants, it is also possible to use refrigerants used for heat-pump circuits of vapor compression type such as CO2 refrigerants, HC refrigerants (such as propane and isobutane refrigerants, for example), ammonia refrigerants, and mixed refrigerants of the above-mentioned refrigerants such as mixed refrigerants of R32 and HFO-1234yf.

While description is given on an example in which two indoor units B and C are connected with one outdoor unit A in Embodiment 1, the indoor unit may be one. Further, two or more outdoor units may be connected in parallel. Further, three extension pipes may be connected in parallel. Further, the apparatus may be configured of a refrigerant circuit allowing the cooling and heating simultaneous operation in which switching valves are provided to the indoor unit side to enable respective indoor units to select cooling or heating, respectively.

Next, a configuration of a refrigerant circuit in the air-conditioning apparatus 100 of Embodiment 1 will be described. The refrigerant circuit of the air-conditioning apparatus 100 has, as a main circuit, a refrigerant circuit including a compressor 1, a cooling/heating switching device 2 for switching between cooling and heating, indoor heat exchangers 3-*b* and 3-*c*, flow rate control devices 4-*b* and 4-*c*, and an outdoor heat exchanger 5, which are connected sequentially via pipes. Further, the air-conditioning apparatus 100 of Embodiment 1 also includes an accumulator 6 on the main circuit. The accumulator 6 is used for accumulating refrigerant of a difference from a required refrigerant amount at the time of cooling and heating, although it is not an indispensable configuration. For example, a container for accumulating liquid refrigerant may be provided in the refrigerant circuit other than a suction unit of the compressor 1.

The indoor units B and C include indoor heat exchangers 3-*b* and 3-*c*, flow rate control devices 4-*b* and 4-*c*, and indoor fans 19-*b* and 19-*c*, respectively. The indoor heat exchangers 3-*b* and 3-*c* allow heat exchange between refrigerant and the air in the room (to be air-conditioned). For example, at the time of cooling operation, each of them functions as an evaporator, and allows to exchange heat between refrigerant and the air in the room (to be air-conditioned) to evaporate and vaporize the refrigerant. Further, at the time of heating operation, it functions as a condenser (radiator), and allows to exchange heat between refrigerant and the air in the room to condense and vaporize the refrigerant. The indoor fans 19-*b* and 19-*c* allow the air in the rooms to pass through the indoor heat exchangers 3-*b* and 3-*c* to form air flows sent into the rooms. The flow rate control devices 4-*b* and 4-*c* are configured of electronic expansion valves or other devices, for example. The flow rate control devices 4-*b* and 4-*c* change the opening degree based on an instruction from the controller 30 to adjust the pressure, temperature, and the like of the refrigerant in the indoor heat exchangers 3-*b* and 3-*c*.

Next, a configuration of the outdoor unit A will be described. The compressor 1 compresses sucked refrigerant and discharges thereof. In this example, the compressor 1 may be configured such that the driving frequency is changed arbitrarily by an inverter circuit or the like to change the capacity (refrigerant feed amount per unit time) of the compressor 1, although it is not particularly limited to this configuration. The cooling/heating switching device 2 is connected between a discharge pipe 1*a* provided on the discharge side of the compressor 1 and a suction pipe 1*b* provided on the suction side, and performs switching between the flow directions of the refrigerant. The cooling/heating switching device 2 is configured of a four-way valve, for example. Then, in the heating operation, connection of the cooling/heating switching device 2 is switched to be in a solid line direction shown in FIG. 1. Further, in the cooling operation, connection of the cooling/heating switching device 2 is switched to be in a dotted line direction shown in FIG. 1.

Figure 2:
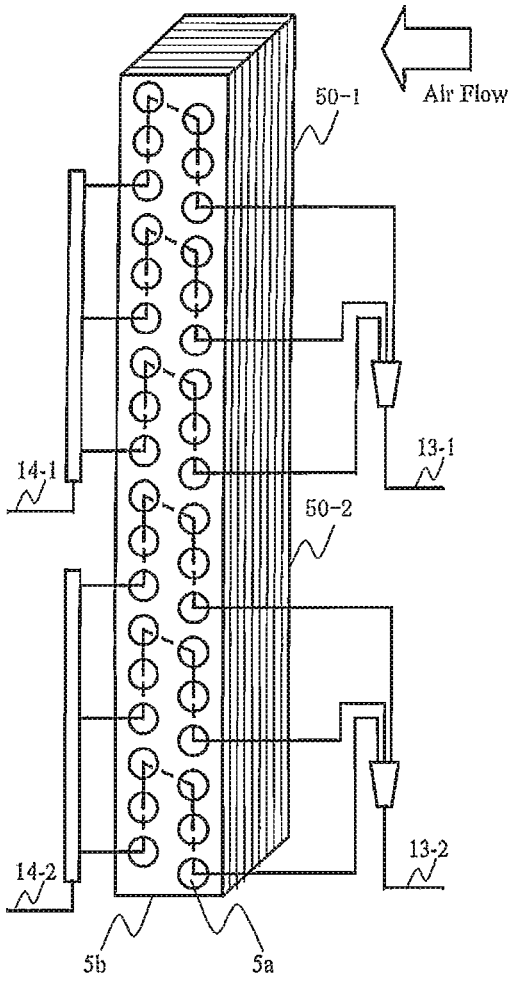
FIG. 2 is a diagram showing an exemplary configuration of an outdoor heat exchanger 5 of the air-conditioning apparatus 100 according to Embodiment 1 of the present invention.

FIG. 2 is a diagram showing an exemplary configuration of the outdoor heat exchanger 5 included in the outdoor unit A according to Embodiment 1 of the present invention. As shown in FIG. 2, the outdoor heat exchanger 5 of Embodiment 1, serving as a heat source side heat exchanger, is a fin tube type heat exchanger including a plurality of heat transfer tubes 5*a* and a plurality of fins 5*b*, for example. Further, the outdoor heat exchanger 5 of Embodiment 1 is configured to be divided into a plurality of parallel heat exchangers 50. In this example, description is exemplary given on the case where the outdoor heat exchanger 5 is divided into two parallel heat exchangers 50-1 and 50-2. As such, in Embodiment 1, each of the parallel heat exchangers 50-1 and 50-2 serves as a heat source side heat exchanger of the present invention.

The heat transfer tubes 5*a*, in each of which refrigerant passes through, are provided in a step direction vertical to the air passing direction and a column direction that is the air passing direction. Further, the fins 5*b* are arranged at intervals to allow the air to pass through in the air passing direction. The outdoor heat exchanger 5 of Embodiment 1 is dividedly arranged as the parallel heat exchangers 50-1 and 50-2. The direction of divided arrangement may be a right and left direction. However, in the case of dividing the outdoor heat exchanger 5 into right and left, the respective refrigerant inlets of the parallel heat exchangers 50-1 and 50-2 are located at both right and left ends of the outdoor unit A, whereby pipe connection becomes complicated. As such, it is preferable to arrange the parallel heat exchangers 50-1 and 50-2 in the up and down direction as shown in FIG. 2, for example. Here, in Embodiment 1, while the fin 5*b* is not divided into two as shown in FIG. 2, each of the parallel heat exchanger 50-1 side and the parallel heat exchanger 50-2 side may have the fin 5*b* independently. Further, while the outdoor heat exchanger 5 is divided into two, namely the parallel heat exchanger 50-1 and the parallel heat exchanger 50-2, in Embodiment 1, the number of division is not limited to two. It may be divided into any number of two or more.

An outdoor fan 5*f* sends the outside air (the air outside the room) to the parallel heat exchangers 50-1 and the 50-2. While Embodiment 1 is configured such that one outdoor fan 5*f* sends the outside air to the parallel heat exchangers 50-1 and 50-2, each of the parallel heat exchangers 50-1 and 50-2 may be provided with the outdoor fan 5*f* to be able to perform air flow control independently.

Further, the parallel heat exchangers 50-1 and 50-2 and the second extension pipes 12 (flow rate control devices 4-*b* and 4-*c*) are connected with each other by first connection pipes 13-1 and 13-2, respectively. The first connection pipes 13-1 and 13-2 are provided with second expansion devices 7-1 and 7-2, respectively. Each of the second expansion devices 7-1 and 7-2 is configured of an electronic control type expansion valve. The second expansion devices 7-1 and 7-2 are able to change the opening degree based on an instruction from the controller 30. Further, the parallel heat exchangers 50-1 and 50-2 and the cooling/heating switching device 2 (compressor 1) are connected with each other by second connection pipes 14-1 and 14-2, respectively. Further, the second connection pipes 14-1 and 14-2 are provided with first solenoid valves 8-1 and 8-2, respectively.

Further, the outdoor unit A of the air-conditioning apparatus 100 of Embodiment 1 includes a first defrosting pipe 15 for supplying a part of high-temperature and high-pressure refrigerant, discharged from the compressor 1, to the outdoor heat exchanger 5 for defrosting in the heating operation, for example. The first defrosting pipe 15 is connected with a discharge pipe 1*a* at one end thereof. Further, the other end side thereof is branched, and the branched ends are connected with the second connection pipes 14-1 and 14-2, respectively.

Further, the first defrosting pipe 15 is provided with a first expansion device 10 serving as a decompressor. The first expansion device 10 decompresses high-temperature and high-pressure refrigerant, flowing from the discharge pipe 1*a* to the first defrosting pipe 15, to have a medium pressure. The decompressed refrigerant flows to the sides of the parallel heat exchangers 50-1 and 50-2. Further, in the first defrosting pipe 15, the branched pipes are provided with second solenoid valves 9-1 and 9-2, respectively. The second solenoid valves 9-1 and 9-2 control whether or not to allow the refrigerant flowing in the first defrosting pipe 15 to pass through the second connection pipes 14-1 and 14-2. In this example, as for the first solenoid valves 8-1 and 8-2 and the second solenoid valves 9-1 and 9-2, the type thereof is not limited if they are valves capable of controlling the flow of refrigerant, such as a four-way valve, a three-way valve, or a two-way valve.

In this example, if a required defrosting capability (refrigerant flow rate required for defrosting) has been determined, a capillary tube may be provided to the first defrosting pipe 15 as the first expansion device 10 (decompressor). Further, in place of the first expansion device 10, the size of the solenoid valves 9-1 and 9-2 may be reduced such that the pressure is lowered to a medium pressure at the time of preset defrosting flow rate. Further, in place of the second solenoid valves 9-1 and 9-2, it is possible to provide a flow rate control device without providing the first expansion device 10.

Further, although not shown, the air-conditioning apparatus 100 is provided with detection units (sensors) such as a pressure sensor and a temperature sensor for controlling frequency of the compressor 1, the outdoor fan 5*f*, and devices serving as actuators such as various types of flow rate control devices. Here, sensors required for performing medium-pressure defrosting, determination of completion of defrosting, and the like will be described, particularly. The first defrosting pipe 15 is provided with a pressure sensor 21. Further, the first connection pipes 13-1 and 13-2, serving as pipes on the refrigerant outflow side when performing defrosting on the parallel heat exchangers 50-1 and 50-2, are provided with temperature sensors 22-1 and 22-2 for measuring the refrigerant temperature, respectively. In the case of controlling the pressure of the parallel heat exchanger 50 (outdoor heat exchanger 5) to be defrosted, a pressure detected by the pressure sensor 21 is used. Further, as for calculation of subcooling SC on the refrigerant outflow side of the outdoor heat exchanger 5 to be used for determining completion of defrosting, a temperature difference between the saturated liquid temperature and each of the temperatures detected by the temperature sensors 22-1 and 22-2 is used. In this example, to detect the pressure of the parallel heat exchanger 50 to be defrosted, each of the first connection pipes 13-1 and 13-2 may be provided with a pressure sensor, in place of the pressure sensor 21.

Next, operating actions in various types of operation performed by the air-conditioning apparatus 100 will be described. Operating actions of the air-conditioning apparatus 100 has two types of operation modes namely a cooling operation and a heating operation. Further, the heating operation includes a heating normal operation in which both the parallel heat exchangers 50-1 and 50-2 each constituting the outdoor heat exchanger 5 operate as normal evaporators, and a heating defrosting operation (also referred to as continuous heating operation). In the heating defrosting operation, the operation is performed to defrost the parallel heat exchanger 50-1 and the parallel heat exchanger 50-2 alternately, while continuing the heating operation. For example, while performing the heating operation by using one parallel heat exchanger 50-1 as an evaporator, the defrosting operation is performed on the other parallel heat exchanger 50-2. Then, upon completion of defrosting of the parallel heat exchanger 50-2, then the heating operation is performed by using the parallel heat exchanger 50-2 as an evaporator, and the defrosting operation is performed on the parallel heat exchanger 50-1.

FIG. 3 is a diagram showing ON/OFF states and opening degree adjusting control states of the respective valves of the air-conditioning apparatus 100 according to Embodiment 1 of the present invention. In FIG. 3, an ON state of the cooling/heating switching device 2 indicates the case where the four-way valve is connected in the directions of solid lines in FIG. 1, while an OFF state indicates the case where the four-way valve is connected in the direction of dotted lines. Further, an ON state of the solenoid valves 8-1 and 8-2 and the solenoid valves 9-1 and 9-2 indicates the case where refrigerant flows because of the valve being opened, while an OFF state indicates the case where the valve is closed.

[Cooling Operation]

Figure 4:
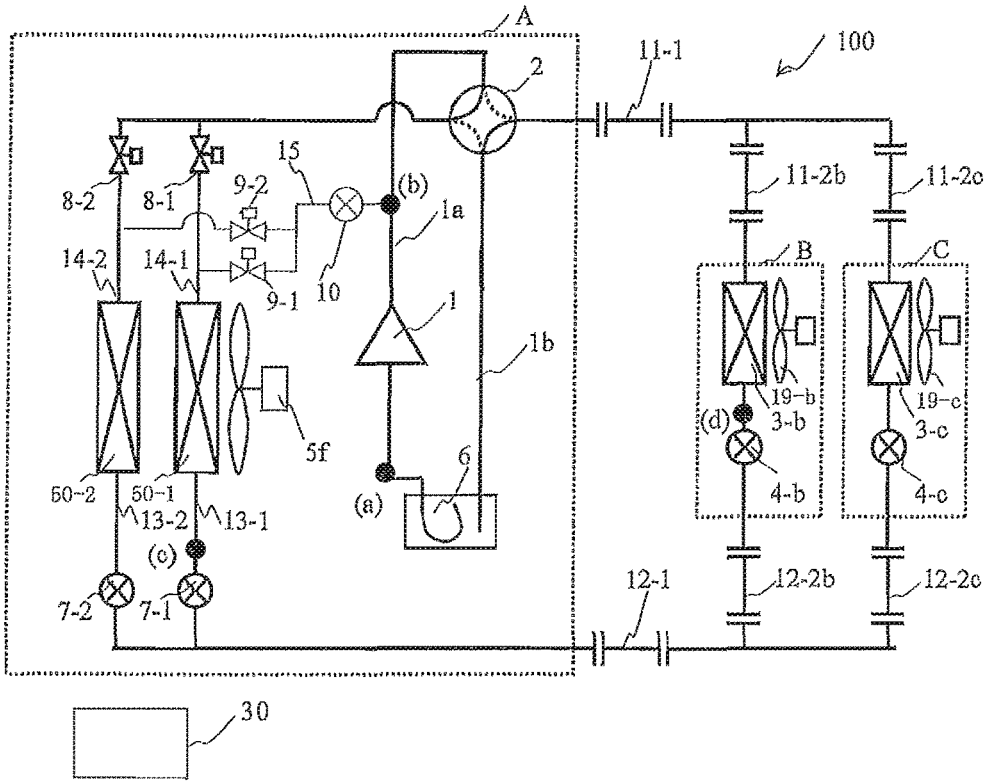
FIG. 4 is a diagram showing a flow of refrigerant at the time of cooling operation of the air-conditioning apparatus 100 according to Embodiment 1 of the present invention.

FIG. 4 is a diagram showing a flow of refrigerant at the time of cooling operation of the air-conditioning apparatus 100 according to Embodiment 1 of the present invention. In FIG. 4, a portion where refrigerant flows at the time of cooling operation is indicated by bold lines, and a portion where refrigerant does not flow is indicated by narrow lines.

Figure 5:
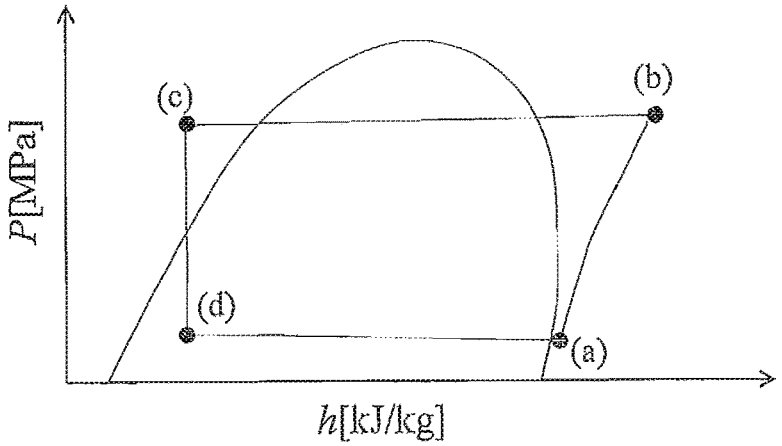
FIG. 5 is a P-h diagram at the time of cooling operation of the air-conditioning apparatus 100 according to Embodiment 1 of the present invention.

FIG. 5 is a P-h diagram at the time of cooling operation of the air-conditioning apparatus 100 according to Embodiment 1 of the present invention. In this example, points (a) to (d) in FIG. 5 show states of the refrigerant in the portions denoted by the same reference characters in FIG. 4. When driving of the compressor 1 is started, the compressor 1 sucks low-temperature and low-pressure gas refrigerant and compresses thereof, and discharges high-temperature and high-pressure gas refrigerant. In the refrigerant compression process by the compressor 1, the refrigerant is compressed to be heated by the amount of heat-resistance efficiency of the compressor 1 compared with the case of being applied with adiabatic compression indicated by an isentropic line, which is expressed by a line shown from the point (a) to the point (b) in FIG. 5.

The flow of high-temperature and high-pressure gas refrigerant discharged from the compressor 1 passes through the cooling/heating switching device 2 and is branched. One flow of refrigerant passes through the solenoid valve 8-1 and the second connection pipe 14-1 and flows into the parallel heat exchanger 50-1. The other flow of refrigerant passes through the solenoid valve 8-2 and the second connection pipe 14-2 and flows into the parallel heat exchanger 50-2. The flows of refrigerant having flowed in the parallel heat exchangers 50-1 and 50-2 heat the outside air, and are cooled, and are condensed to be medium-temperature and high-pressure liquid refrigerants. The change in the refrigerants in the parallel heat exchanger 50-1 and 50-2 is expressed as a slightly-tilted almost horizontal line shown from the point (b) to the point (c) in FIG. 5, in consideration of a pressure loss of the outdoor heat exchanger 5. While it is configured to allow the refrigerant to pass through the parallel heat exchangers 50-1 and 50-2 in Embodiment 1, when the loads in the indoor units B and C are small, the solenoid valve 8-2 may be closed, for example, so as not to allow the refrigerant to flow to the parallel heat exchanger 50-2. With the refrigerant not flowing to the parallel heat exchanger 50-2, the heating area of the outdoor heat exchanger 5 is reduced consequently, whereby it is possible to perform a stable operation.

The flows of liquid refrigerant having flowed out of the parallel heat exchangers 50-1 and 50-2 pass through the first connection pipes 13-1 and 13-2 and the fully opened second expansion devices 7-1 and 7-2, and then are joined. The joined flow of refrigerant passes through the second extension pipes 12-1, and then, is branched again into the second extension pipes 12-2*b* and 12-2*c*, and the branched flows of refrigerant each pass through the flow rate control devices 4-*b* and 4-*c*. The flows of refrigerant having passed through the flow rate control devices 4-*b* and 4-*c* are expanded, decompressed, and turned into a state of low-temperature and low-pressure two-phase gas-liquid. The change in the refrigerant in the flow rate control devices 4-*b* and 4-*c* is performed under constant enthalpy. The change in the refrigerant at this time is expressed as a vertical line shown from the point (c) to the point (d) of FIG. 5.

The flows of refrigerant in a low-temperature and low-pressure two-phase gas-liquid state, having flowed out of the flow rate control devices 4-*b* and 4-*c*, flow into the indoor heat exchangers 3-*b* and 3-*c*. The flows of refrigerant having flowed in the indoor heat exchangers 3-*b* and 3-*c* cool the air inside the room, and are heated to be low-temperature and low-pressure gas refrigerants. Here, the controller 30 controls the flow rate control devices 4-*b* and 4-*c* such that the superheat (degree of superheat) of the low-temperature and low-pressure gas refrigerants reaches about 2K to 5K. The change in the refrigerant in the indoor heat exchangers 3-*b* and 3-*c* is expressed as a slightly-tilted almost horizontal line shown from the point (d) to the point (a) in FIG. 5, in consideration of a pressure loss.

The flows of low-temperature and low-pressure gas refrigerant having flowed out of the indoor heat exchangers 3-*b* and 3-*c* pass through the first extension pipes 11-2*b* and 11-2*c* and are joined, and the joined refrigerant further passes through the first extension pipe 11-1. Then, it returns to the outdoor unit A, passes through the cooling/heating switching device 2 and the accumulator 6, and then is sucked by the compressor 1.

[Heating Normal Operation]

Figure 6:
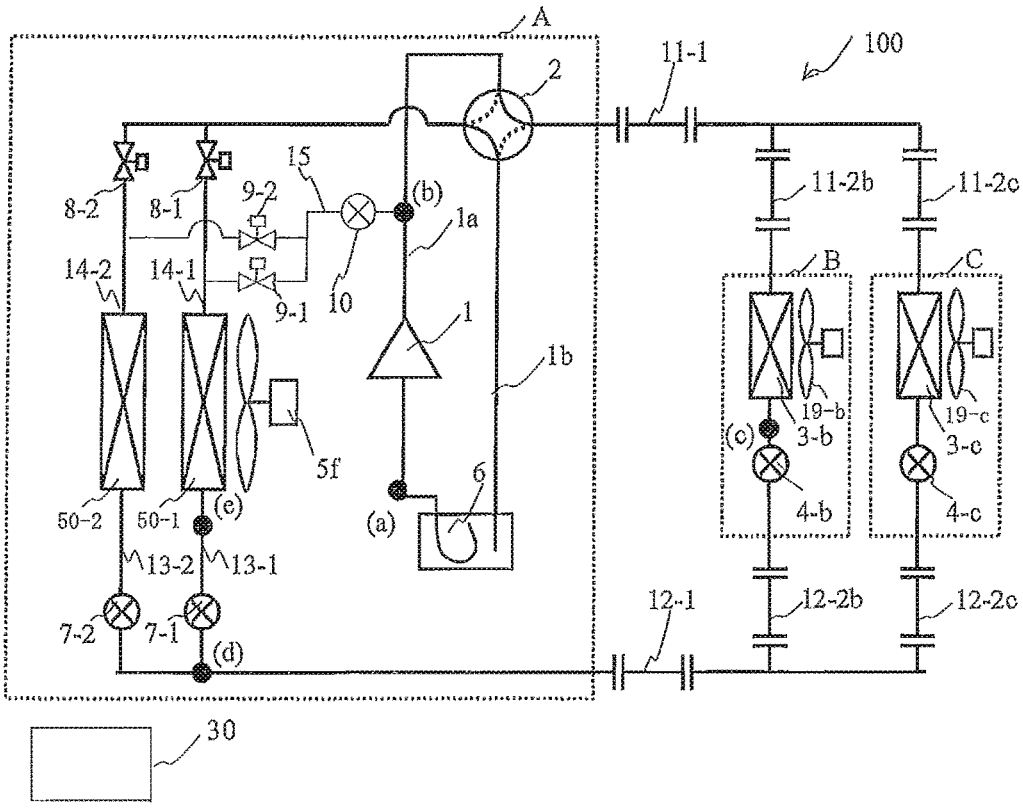
FIG. 6 is a diagram showing a flow of refrigerant at the time of heating normal operation of the air-conditioning apparatus 100 according to Embodiment 1 of the present invention.

FIG. 6 is a diagram showing a flow of refrigerant at the time of heating normal operation of the air-conditioning apparatus 100 according to Embodiment 1 of the present invention. In FIG. 6, a portion where refrigerant flows at the time of heating normal operation is indicated by bold lines, and a portion where refrigerant does not flow is indicated by narrow lines.

Figure 7:
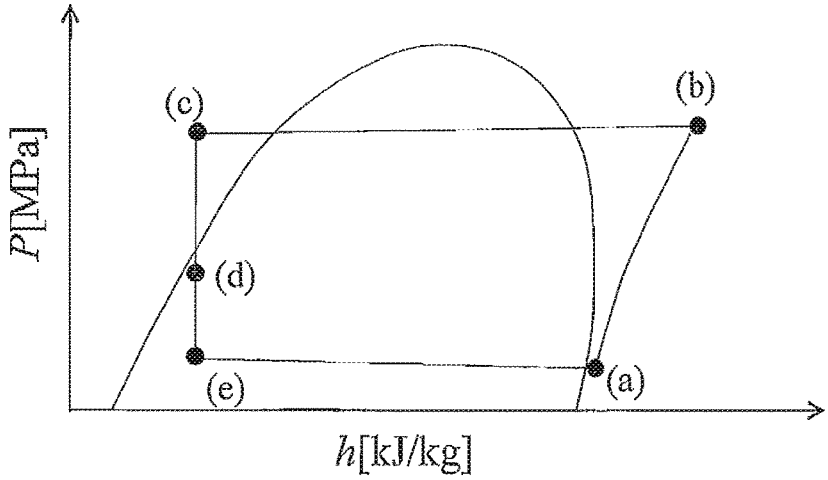
FIG. 7 is a P-h diagram at the time of heating normal operation of the air-conditioning apparatus 100 according to Embodiment 1 of the present invention.

FIG. 7 is a P-h diagram at the time of heating normal operation of the air-conditioning apparatus 100 according to Embodiment 1 of the present invention. In this example, points (a) to (e) in FIG. 7 show states of the refrigerant in the portions denoted by the same reference characters in FIG. 6. When driving of the compressor 1 is started, the compressor 1 sucks low-temperature and low-pressure gas refrigerant and compresses thereof, and discharges high-temperature and high-pressure gas refrigerant. In the refrigerant compression process by the compressor 1, the refrigerant is compressed so as to be heated by the amount of heat-resistance efficiency of the compressor 1 compared with the case of being applied with adiabatic compression indicated by an isentropic line, which is expressed by a line from the point (a) to the point (b) in FIG. 7.

The high-temperature and high-pressure gas refrigerant discharged from the compressor 1 passes through the cooling/heating switching device 2, and then flows out from outdoor unit A. The flow of high-temperature and high-pressure gas refrigerant, having flowed out of the outdoor unit A, passes through the first extension pipe 11-1, and is branched into the flows each flowing into the first extension pipes 11-2*b* and 11-2*c*, and the branched flows of refrigerant each flow into the indoor heat exchangers 3-*b* and 3-*c* of the corresponding indoor units B and C.

The flows of refrigerant having flowed in the indoor heat exchangers 3-*b* and 3-*c* heat the air in the room, and are cooled, and condensed to be medium-temperature and high-pressure liquid refrigerant. The change in the refrigerant in the indoor heat exchangers 3-*b* and 3-*c* is expressed as a slightly-tilted almost horizontal line shown from the point (b) to the point (c) in FIG. 7.

The flows of medium-temperature and high-pressure liquid refrigerant having flowed out of the indoor heat exchangers 3-*b* and 3-*c* each pass through the flow rate control devices 4-*b* and 4-*c*. The refrigerant having passed through the flow rate control devices 4-*b* and 4-*c* are expanded, decompressed, and tuned into a medium-pressure two-phase gas-liquid state. The change in the refrigerant at this time is expressed as a vertical line shown from the point (c) to the point (d) in FIG. 7. In this example, the controller 30 controls the flow rate control devices 4-*b* and 4-*c* such that subcooling (degree of subcooling) of the medium-temperature and high-pressure liquid refrigerant in the flow rate control devices 4-*b* and 4-*c* reaches about 5K to 20K.

The flows of refrigerant in the medium-pressure two-phase gas-liquid state, having flowed out of the flow rate control devices 4-*b* and 4-*c*, each pass through the second extension pipes 12-2*b* and 12-2*c* and are joined, and the joined refrigerant further passes through the second extension pipes 12-1 and returns to the outdoor unit A.

The refrigerant returned to the outdoor unit A is branched, and the branched flows of refrigerant each pass through the first connection pipes 13-1 and 13-2. At this time, the flows of refrigerant each pass through the second expansion devices 7-1 and 7-2. The flows of refrigerant having passed through the second expansion device 7-1 and 7-2 are expanded, decompressed, turned into a low-pressure two-phase gas-liquid state. The change in the refrigerant at the time is shown from the point (d) to the point (e) in FIG. 7. Here, the controller 30 controls the second expansion devices 7-1 and 7-2 such that they are fixed at a certain opening degree, that is, a fully-opened state for example, or that the saturation temperature of the medium pressure in the second extension pipe 12-1 and the like reaches about 0 degrees C. to 20 degrees C.

The flows of refrigerant having flowed out of the first connection pipes 13-1 and 13-2 (second expansion devices 7-1 and 7-2) flow into the parallel heat exchangers 50-1 and 50-2. The flows of refrigerant having flowed in the parallel heat exchangers 50-1 and 50-2 cool the outside air, and are heated and vaporized to be low-temperature and low-pressure gas refrigerant. The change in the refrigerant in the parallel heat exchangers 50-1 and 50-2 is expressed as a slightly-tilted almost horizontal line shown from the point (e) to the point (a) in FIG. 7.

The flows of low-temperature and low-pressure gas refrigerant having flowed out of the parallel heat exchangers 50-1 and 50-2 each pass through the second connection pipes 14-1 and 14-2 and the solenoid valves 8-1 and 8-2, and then are joined, and the joined refrigerant passes through the cooling/heating switching device 2 and the accumulator 6, and is sucked by the compressor 1.

[Heating Defrosting Operation (Continuous Heating Operation)]

Heating defrosting operation is performed in the case of defrosting the frost deposited on the outdoor heat exchanger 5 during heating normal operation. Here, there are a plurality of methods for determining whether or not to perform defrosting. For example, it is determined to perform defrosting when the saturation temperature, converted from the pressure of the suction side of the compressor 1, is determined to drop significantly compared with the preset outside air temperature. Alternatively, it is determined to perform defrosting when a temperature difference between the outside air temperature and the evaporating temperature reaches a preset value or larger and it is determined that the elapsed time reaches a certain time or longer, for example.

In the configuration of the air-conditioning apparatus 100 according to Embodiment 1, in heating defrosting operation, there is an operation in which defrosting of the parallel heat exchanger 50-2 is performed and the parallel heat exchanger 50-1 functions as an evaporator to continue heating. On the contrary, there is an operation in which the parallel heat exchanger 50-2 functions as an evaporator to continue heating, and defrosting of the parallel heat exchanger 50-1 is performed. In these operations, although the open/close states of the solenoid valves 8-1 and 8-2 and the open/close states of the solenoid valve 9-1 and 9-2 are turned other way round and the flow of the refrigerant in the parallel heat exchanger 50-1 and the flow of the refrigerant in the parallel heat exchanger 50-2 are turned around, the other actions are the same. As such, in the below description, an operation in which defrosting of the parallel heat exchanger 50-2 is performed and the parallel heat exchanger 50-1 functions as an evaporator to continue heating will be described. This also applies to the embodiments provided below.

Figure 8:
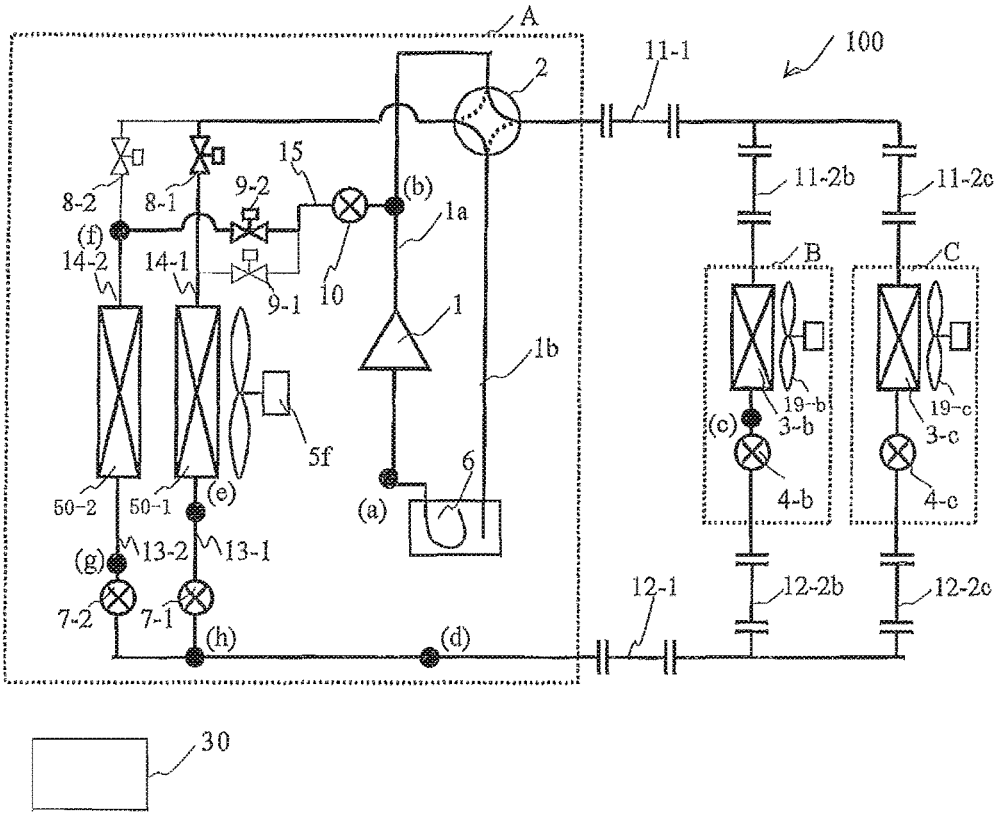
FIG. 8 is a diagram showing a flow of refrigerant at the time of heating defrosting operation of the air-conditioning apparatus 100 according to Embodiment 1 of the present invention.

FIG. 8 is a diagram showing a flow of refrigerant at the time of heating defrosting operation of the air-conditioning apparatus 100 according to Embodiment 1 of the present invention. In FIG. 8, a portion where refrigerant flows at the time of heating defrosting operation is indicated by bold lines, and a portion where refrigerant does not flow is indicated by narrow lines.

Figure 9:
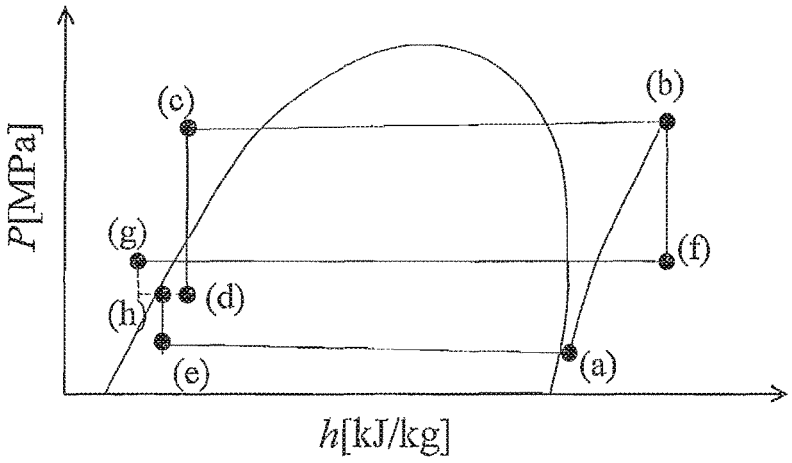
FIG. 9 is a P-h diagram at the time of heating defrosting operation of the air-conditioning apparatus 100 according to Embodiment 1 of the present invention.

FIG. 9 is a P-h diagram at the time of the heating defrosting operation of the air-conditioning apparatus 100 according to Embodiment 1 of the present invention. In this example, points (a) to (h) in FIG. 9 indicate states of the refrigerant at the portions denoted by the same reference characters in FIG. 8. When the controller 30 determines that it is necessary to perform defrosting to dissolve a frosted state during heating normal operation, the controller 30 closes the solenoid valve 8-2 corresponding to the parallel heat exchanger 50-2 to be defrosted. Then, the controller 30 opens the second solenoid valve 9-2, and performs control to allow the opening degree of the first expansion device 10 to be a preset opening degree. Thereby, a medium-pressure defrosting circuit in which the compressor 1→the first expansion device 10→the solenoid valve 9-2→the parallel heat exchanger 50-2→the second expansion device 7-2→the second expansion device 7-1 are connected sequentially, is formed besides the main circuit, and heating defrosting operation starts.

When the heating defrosting operation starts, a part of the high-temperature and high-pressure gas refrigerant discharged from the compressor 1 flows into the first defrosting pipe 15, and the pressure thereof is decompressed to a medium pressure by the first expansion device 10. The change in the refrigerant at this time is expressed from the point (b) to the point (f) in FIG. 9. Then, the refrigerant in which the pressure is decompressed to a medium pressure (point (f)) passes through the solenoid valve 9-2, and flows into the parallel heat exchanger 50-2. The refrigerant having flowed in the parallel heat exchanger 50-2 is cooled by exchanging heat with the frost deposited on the parallel heat exchanger 50-2. In this way, by allowing the high-temperature and high-pressure gas refrigerant, discharged from the compressor 1, to flow into the parallel heat exchanger 50-2, the frost deposited on the parallel heat exchanger 50-2 can melt. The change in the refrigerant at this time is expressed as a change from the point (f) to the point (g) in FIG. 9. Here, the refrigerant for performing defrosting has saturation temperature of about 0 degrees C. to 10 degrees C. (in the case of R410A refrigerant, 0.8 MPa to 1.1 MPa) that is the temperature (0 degrees C.) of the frost or higher.

On the other hand, by increasing the opening degree of the second expansion device 7-1, the pressure of the refrigerant at the point (d) in the main circuit is lowered than the pressure of the refrigerant at the point (g). Thereby, it is possible to allow the refrigerant after performing defrosting (point (g)) to pass through the second expansion device 7-2 to return to the main circuit. Further, when the resistance of the valve of the second expansion device 7-1 is too large, the pressure of the refrigerant at the point (d) is increased more than the pressure of the refrigerant at the point (g). As such, there is a possibility that the pressure of the refrigerant at the point (g) cannot be controlled to have 0 degrees C. to 10 degrees C. on a saturation temperature conversion basis. As such, it is necessary to design a flow rate coefficient (Cv value) of the valve of the second expansion device 7-1, according to the refrigerant flow rate of the main stream. In this example, as there is also a case where the parallel heat exchanger 50-1 performs defrosting and the parallel heat exchanger 50-2 operates as an evaporator, this also applies to the second expansion device 7-2.

The refrigerant, after performing defrosting, passes through the second expansion device 7-2, and joins the main circuit (point (h)). The joined refrigerant flows into the parallel heat exchanger 50-1 functioning as an evaporator, and is vaporized through heat exchange with the outside air.

Figure 10:
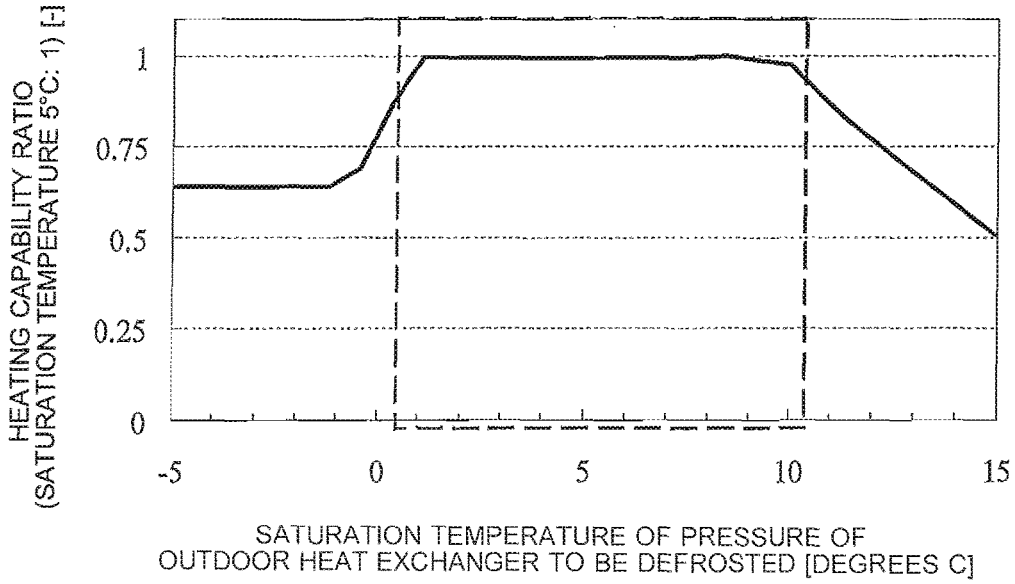
FIG. 10 is a diagram showing a relationship between saturation temperature based on the pressure of the outdoor heat exchanger 5 and a heating capability ratio according to Embodiment 1 of the present invention.

FIG. 10 is a diagram showing a relationship between saturation temperature based on the pressure of the outdoor heat exchanger 5 and a heating capability ratio according to Embodiment 1 of the present invention. FIG. 10 shows a result of calculating heating capability in the case of changing the pressure (having been converted to saturated liquid temperature in FIG. 10) of the parallel heat exchanger 50 to be defrosted while fixing the defrosting capability, in the air-conditioning apparatus 100 using R410A refrigerant as refrigerant.

Figure 11:
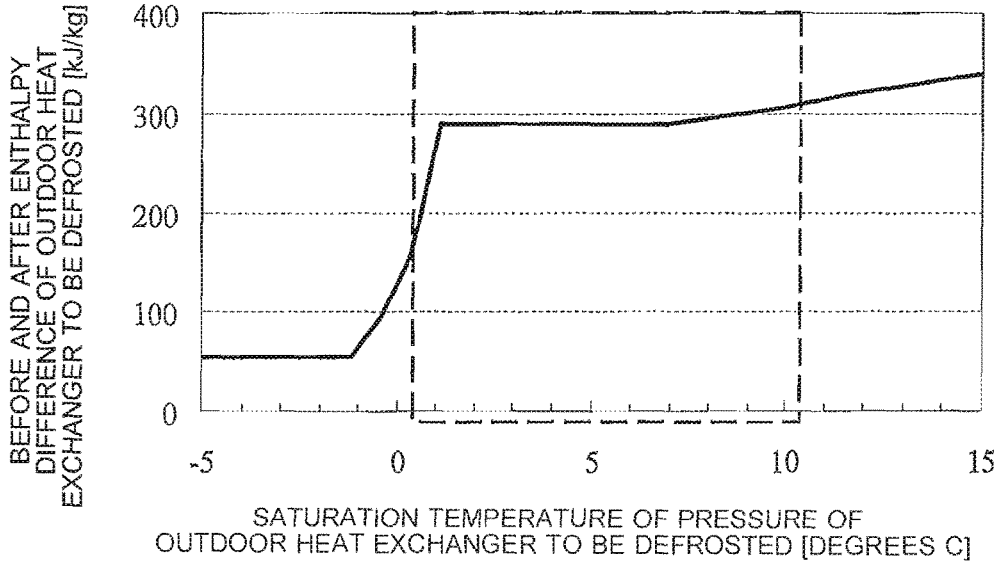
FIG. 11 is a diagram showing a relationship between saturation temperature based on the pressure of the outdoor heat exchanger 5 and a before and after enthalpy difference of a parallel heat exchanger 50 to be defrosted according to Embodiment 1 of the present invention.

FIG. 11 is a diagram showing a relationship between saturation temperature based on the pressure of the outdoor heat exchanger 5 and a before and after enthalpy difference of the parallel heat exchanger 50 to be defrosted, according to Embodiment 1 of the present invention. FIG. 11 shows a result of calculating a before and after enthalpy difference of the parallel heat exchanger 50 to be defrosted in the case of changing the pressure (having been converted to saturated liquid temperature in FIG. 11) of the parallel heat exchanger 50 to be defrosted while fixing the defrosting capability, in the air-conditioning apparatus 100 using R410A refrigerant as refrigerant.

Figure 12:
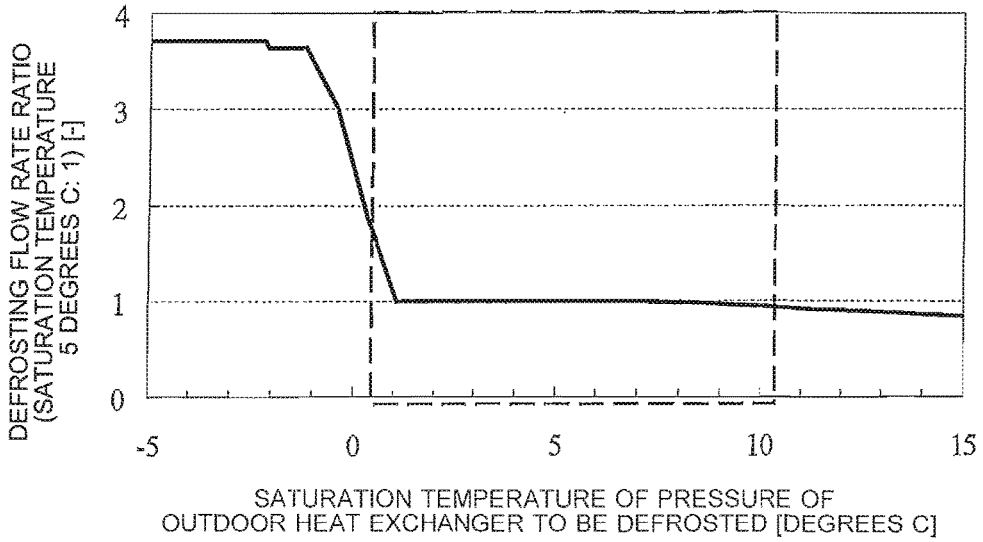
FIG. 12 is a diagram showing a relationship between saturation temperature based on the pressure of the outdoor heat exchanger 5 and a defrosting flow rate ratio according to Embodiment 1 of the present invention.

FIG. 12 is a diagram showing a relationship between saturation temperature based on the temperature of the outdoor heat exchanger 5 and a defrosting flow rate ratio, according to Embodiment 1 of the present invention. FIG. 12 shows a result of calculating a flow rate of refrigerant required for defrosting in the case of changing the pressure (having been converted to saturated liquid temperature in FIG. 12) of the parallel heat exchanger 50 to be defrosted while fixing the defrosting capability, in the air-conditioning apparatus 100 using R410A refrigerant as refrigerant.

Figure 13:
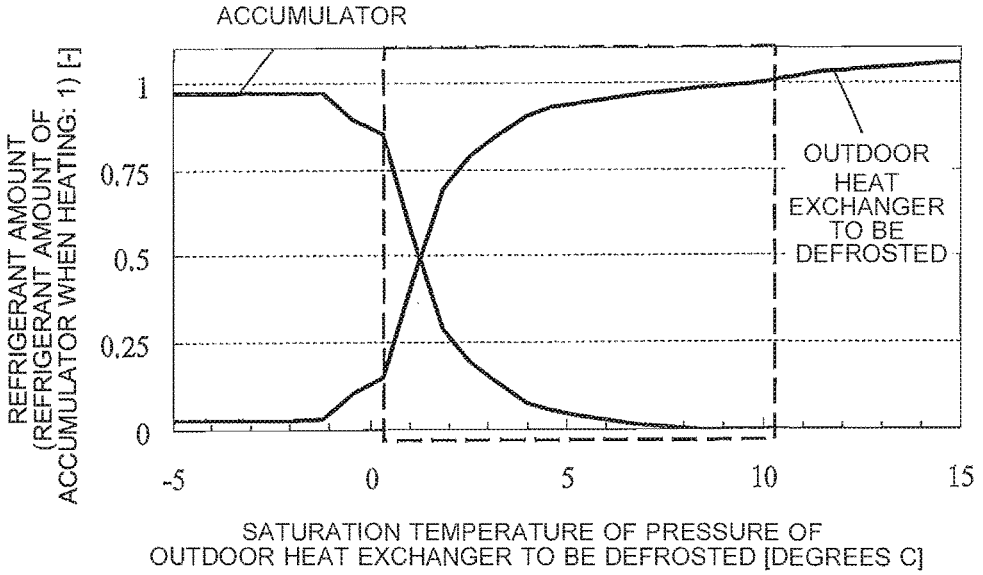
FIG. 13 is a diagram showing a relationship between saturation temperature based on the pressure of the outdoor heat exchanger 5 and the amount of refrigerant according to Embodiment 1 of the present invention.

FIG. 13 is a diagram showing a relationship between saturation temperature based on the pressure of the outdoor heat exchanger 5 and amounts of refrigerant, according to Embodiment 1 of the present invention. FIG. 13 shows a result of calculating the amounts of refrigerant in the accumulator 6 and in the parallel heat exchanger 50 to be defrosted in the case of changing the pressure (having been converted to saturated liquid temperature in the figure) of the parallel heat exchanger 50 to be defrosted while fixing the defrosting capability, in the air-conditioning apparatus 100 using R410A refrigerant as refrigerant.

Figure 14:
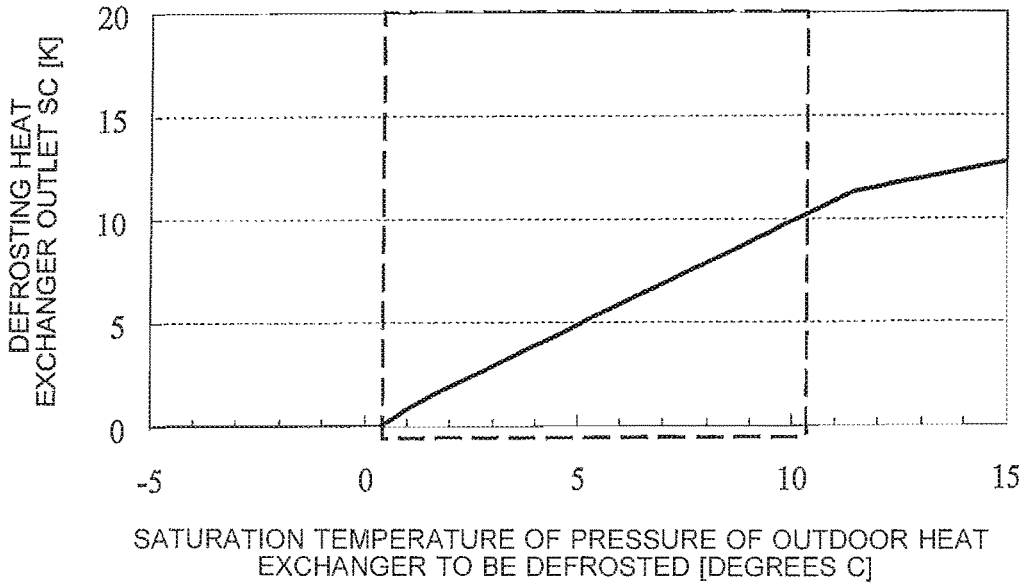
FIG. 14 is a diagram showing a relationship between saturation temperature based on the pressure of the outdoor heat exchanger 5 and subcooling according to Embodiment 1 of the present invention.

FIG. 14 is a diagram showing a relationship between saturation temperature based on the pressure of the outdoor heat exchanger 5 and subcooling, according to Embodiment 1 of the present invention. FIG. 14 shows a result of calculating subcooling (degree of subcooling) SC on the refrigerant outflow side of the parallel heat exchanger 50 to be defrosted in the case of changing the pressure (having been converted to saturated liquid temperature in the figure) of the parallel heat exchanger 50 to be defrosted while fixing the defrosting capability, in the air-conditioning apparatus 100 using R410A refrigerant as refrigerant.

Next, the grounds for setting the saturation temperature of refrigerant used for defrosting to a temperature that is higher than 0 degrees C. but 10 degrees C. or lower will be described with used of FIGS. 10 to 14. As shown in FIG. 10, it is found that in the parallel heat exchanger 50 to be defrosted, the heating capability is increased when the saturated liquid temperature of the refrigerant is higher than 0 degrees C. but 10 degrees or lower, while the heating capability is decreased in other cases.

First, the grounds that the heating capability is decreased when the saturated liquid temperature is 0 degrees C. or lower will be described. To melt frost, the temperature of the refrigerant must be higher than 0 degrees C. As is known from the P-h diagram of FIG. 9, when it is attempted to melt frost by setting the saturated liquid temperature to be 0 degrees C. or lower, the position of the point (g) becomes higher than saturated gas enthalpy. As such, the latent heat of condensation of the refrigerant cannot be used, whereby an enthalpy difference before and after the parallel heat exchanger 50 to be defrosted is decreased (FIG. 11).

At this time, when it is attempted to exhibit the defrosting capability as in the optimum case at the temperature from 0 degrees C. to 10 degrees C., about three to four times as much as flow rate is required to cause inflow to the parallel heat exchanger 50 to be defrosted (FIG. 12). The flow rate of the refrigerant that could be supplied to the indoor units B and C performing heating is reduced by that amount, whereby the heating capability is lowered. When the saturated liquid temperature is set to 0 degrees C. or lower, the heating capability is lowered as in the case of performing low-pressure defrosting of Patent Literature 1 described above. As such, the pressure of the parallel heat exchanger 50 to be defrosted, on a saturated liquid temperature conversion basis, must be 0 degrees C. or higher.

On the other hand, when the pressure of the parallel heat exchanger 50 to be defrosted is increased, subcooling SC at the refrigerant outflow port of the parallel heat exchanger 50 to be defrosted increases, as shown in FIG. 14. As such, the amount of liquid refrigerant increases, and the refrigerant density increases. In a typical multi-air-conditioning apparatus for a building, the required amount of refrigerant is larger at the time of cooling than that of the heating. As such, at the time of heating operation, excess refrigerant exists in a liquid reservoir such as the accumulator 6.

However, as shown in FIG. 13, when the pressure in the parallel heat exchanger 50 to be defrosted increases (saturation temperature increases), the amount of refrigerant required for defrosting increases. As such, the amount of refrigerant stored in the accumulator 6 decreases, and the accumulator 6 becomes empty when the saturation temperature is about 10 degrees C. When there is no extra liquid refrigerant in the accumulator 6, the refrigerant in the refrigerant circuit is in short, and the suction density of the compressor 1 is lowered and the like, whereby the heating capability is lowered.

Here, it is possible to increase the upper limit of the saturation temperature by overfilling the refrigerant. However, there is a possibility that excess refrigerant overflows from the accumulator 6 at the time of another type of operation, for example, which reduces credibility of the air-conditioning apparatus 100. As such, it is preferable to fill the refrigerant adequately. Further, as the saturation temperature rises, there is a problem that a temperature difference between the refrigerant in the heat exchanger and the frost varies, causing a portion where the frost melted quickly and a portion where the frost is hard to melt.

Due to the above grounds, in the air-conditioning apparatus 100 of Embodiment 1, the pressure in the parallel heat exchanger 50 to be defrosted is set to, on a saturation temperature conversion basis, higher than 0 degrees but 10 degrees C. or lower. Here, in consideration of suppressing movement of refrigerant during defrosting and preventing unevenness melting while making the best of the medium-pressure defrosting using latent heat, it is most suitable to set a target value of the subcooling SC in the parallel heat exchanger 50 to be defrosted to 0 K. However, in consideration of the accuracy of a temperature sensor, a pressure sensor, and other devices for computing subcooling or the like, it is desirable to set the pressure of the parallel heat exchanger 50 to be defrosted to, on a saturation temperature conversion basis, higher than 0 degrees C. but 6 degrees C. or lower such that the subcooling SC is in the range of about 0 K to 5 K.

An exemplary operation of the first expansion device 10 and the second expansion devices 7-1 and 7-2, during heating defrosting operation, will be described further. During heating defrosting operation, the controller 30 controls the opening degree of the second expansion device 7-2 such that the pressure of the parallel heat exchanger 50-2 to be defrosted reaches, on a saturation temperature conversion basis, about 0 degrees C. to 10 degrees C. On the other hand, the opening degree of the second expansion device 7-1 is controlled to be in a fully opening state, to improve controllability by making a difference before and after the second expansion device 7-2. Further, during heating defrosting operation, a difference between the discharge pressure of the compressor 1 and the pressure of the parallel heat exchanger 50-2 to be defrosted does not vary largely. As such, the opening degree of the first expansion device 10 is fixed at an opening degree according to the required flow rate of defrosting designed in advance.

Here, the heat transferred from the refrigerant for defrosting not only moves to the frost deposited on the parallel heat exchanger 50-2, part of the heat may also be transferred to the outside air. As such, the controller 30 may control the first expansion device 10 and the second expansion device 7-2 to increase the flow rate of defrosting when the outside air temperature drops. Thereby, the heat given to the frost can be constant and the time taken for defrosting can be constant, regardless of the outside air temperature.

Further, the controller 30 may change a threshold of saturation temperature to be used for determining presence/absence of frost, the time of normal operation, and the like, according to the outside air temperature. When the outside air temperature is low, the operating time of normal heating operation is shorten to make the frosting amount at the time of starting heating defrosting operation constant. Thereby, during heating defrosting operation, the heat given from the refrigerant to the frost can be constant. As such, there is no need to control the flow rate of defrosting by the first expansion device 10, so that it is possible to use an inexpensive capillary tube having a constant channel resistance as the first expansion device 10.

Further, the controller 30 may set a threshold of the outside air temperature, and when the outside air temperature is the threshold (for example, outside air temperature is −5 degrees C., −10 degrees C., or the like) or higher, the controller 30 may perform the heating defrosting operation, while when the outside air temperature is less than the threshold, the controller 30 may stop heating of the indoor unit B or the like and perform the heating stop defrosting operation to defrost every parallel heat exchanger 50.

When the outside air temperature is as low as 0 degrees C. or lower such as −5 degrees C. or −10 degrees C., as the absolute humidity of the outside air is low originally, the frost amount is small, so that a longer time is taken for the normal operation until the frosting amount reaches a predetermined amount. As such, even if heating of the indoor unit is stopped and all surfaces of the parallel heat exchangers 50 are defrosted, the time when heating of the indoor unit is stopped is short. In the case of performing the heating defrosting operation, when also considering rejecting heat from the parallel heat exchanger 50 to be defrosted to the outside air, defrosting can be performed efficiently by performing either the heating defrosting operation or the heating stop defrosting operation selectively according to the outside air temperature.

Here, in the heating stop defrosting operation, it is set that the cooling/heating switching device 2 is turned OFF, the second expansion devices 7-1 and 7-2 are fully opened, the solenoid valve 8-2 and 8-1 are opened, the second solenoid valves 9-1 and 9-2 are closed, and the first expansion device 10 is closed. Thereby, the high-temperature and high-pressure gas refrigerant, discharged from the compressor 1, passes through the cooling/heating switching device 2 and the solenoid valve 8-1 and solenoid valve 8-2, and flows into the parallel heat exchangers 50-1 and 50-2, and the frost deposited on the parallel heat exchangers 50-1 and 50-2 can be defrosted.

Further, in the case of configuring the parallel heat exchangers 50-1 and 50-2 integrally and the outside air is delivered to the parallel heat exchanger 50 to be defrosted by the outdoor fan **5*f*** as in the case of Embodiment 1, the fan output may be changed when the outside air temperature is low to reduce the heat discharge amount at the time of the heating defrosting operation.

Figure 15:
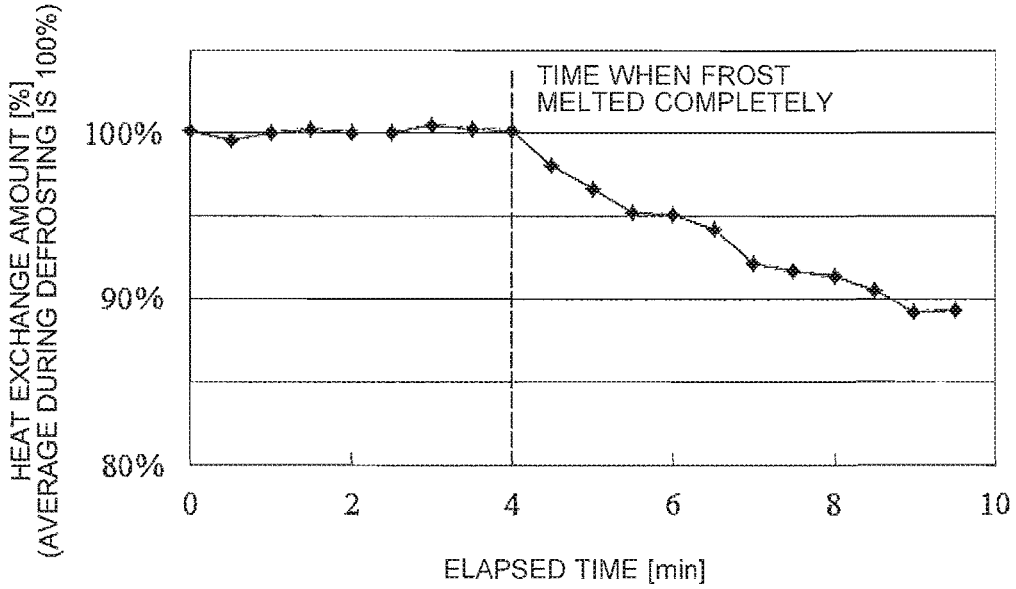
FIG. 15 is a diagram showing a relationship between the heat exchange amount of the parallel heat exchanger 50 to be defrosted and time, when the heating defrosting operation is performed, according to Embodiment 1 of the present invention.

FIG. 15 is a diagram showing a relationship between the heat exchange amount of refrigerant and time in the parallel heat exchanger 50-2 to be defrosted at the time of the heating defrosting operation (the parallel heat exchanger 50-1: evaporator, the parallel heat exchanger 50-2: defrosting), according to Embodiment 1 of the present invention. FIG. 15 shows test results. According to FIG. 15, it is found that the heat exchange amount is reduced when the frost has melted completely. As such, it is possible to determine whether or not defrosting has been completed based on the heat exchange amount. Further, as a method of indirectly predicting the heat exchange amount, there is an index as described below.

Figure 16:
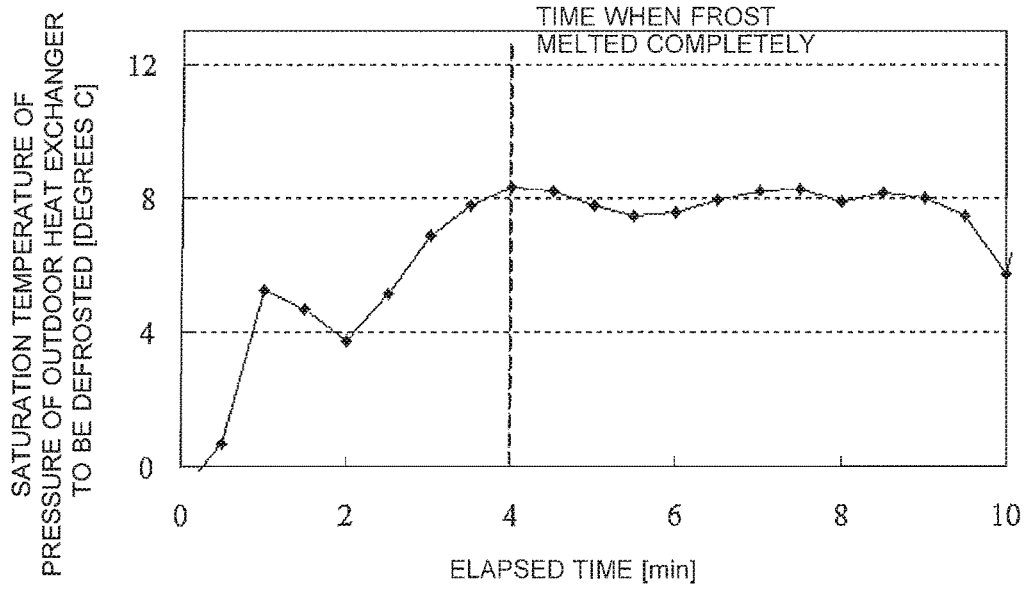
FIG. 16 is a diagram showing a relationship between saturation temperature converted from the pressure of the parallel heat exchanger 50 to be defrosted and time, when the heating defrosting operation is performed, according to Embodiment 1 of the present invention.
Figure 17:
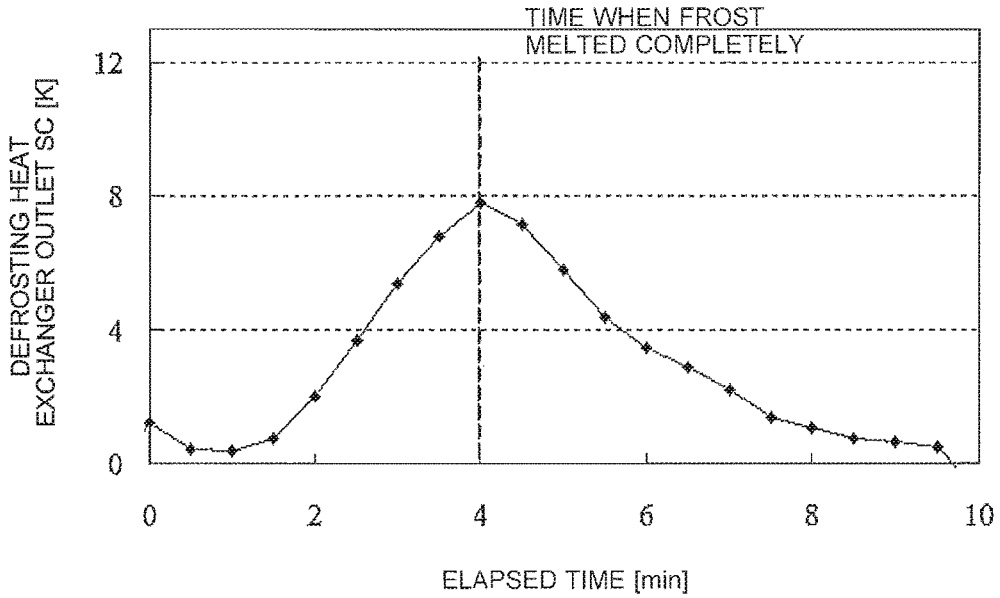
FIG. 17 is a diagram showing a relationship between subcooling SC and time at the refrigerant outlet side of the parallel heat exchanger 50 to be defrosted, when the heating defrosting operation is performed, according to Embodiment 1 of the present invention.
Figure 18:
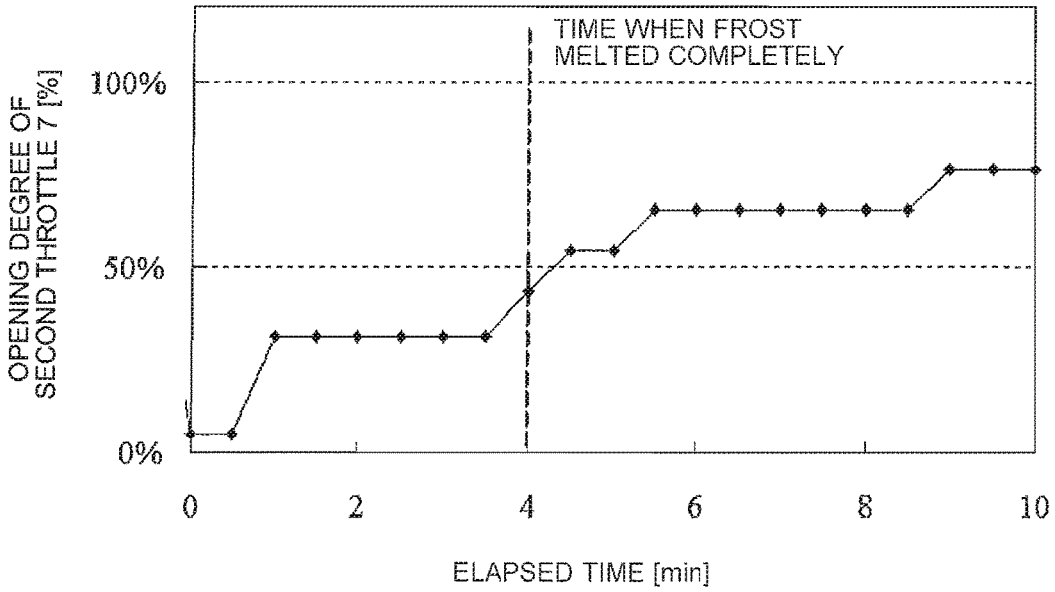
FIG. 18 is a diagram showing a relationship between the opening degree of a second expansion device 7 and time, when the heating defrosting operation is performed, according to Embodiment 1 of the present invention.

FIG. 16 is a diagram showing a relationship between saturation temperature, obtained by converting the pressure of the parallel heat exchanger 50-2 to be defrosted, and time when the heating defrosting operation is performed, according to Embodiment 1 of the present invention. Further, FIG. 17 is a diagram showing a relationship between subcooling SC at the refrigerant outlet side of the parallel heat exchanger 50-2 to be defrosted and time when the heating defrosting operation is performed, according to Embodiment 1 of the present invention. Further, FIG. 18 is a diagram showing a relationship between the opening degree of the second expansion device 7-2 and time when the heating defrosting operation is performed, according to Embodiment 1 of the present invention. FIGS. 16 to 18 show examples of test results.

During heating defrosting operation, the pressure of the parallel heat exchanger 50-2 to be defrosted was controlled at about 0 degrees C. to 10 degrees C. on a saturation temperature conversion basis. In this test, while the frost melted completely when four minutes elapsed from the beginning of the heating defrosting operation, the actuator continued control according to the heating defrosting operation. It is found that when the frost melted completely, the subcooling SC at the refrigerant outlet of the parallel heat exchanger 50-2 to be defrosted was lowered and the opening degree of the second expansion device 7-2 largely increased. This is because while the heat of the refrigerant was conducted to the frost at 0 degrees C. by heat conduction via the heat transfer tube 5*a* and the fin 5*b* until the frost melted completely, after the frost melted completely, it was conducted to the air by convection, so that the heat resistance increased. As such, it is possible to determine whether or not the frost melted completely based on a change in the subcooling SC (for example, the temperature dropped by 5 K or more from the maximum value, the subcooling SC dropped to about 2 K) at the outlet of the parallel heat exchanger 50-2 to be defrosted. Here, the subcooling SC rose until the frost melted completely. This is due to movement of the refrigerant to the parallel heat exchanger 50-2 to be defrosted. As such, the time when the subcooling SC begins to drop after it once rises may be determined to be the time when the frost melted completely.

Further, in FIG. 18, the saturation temperature (pressure) of the parallel heat exchanger 50-2 to be defrosted rises due to an increase in the heat resistance, whereby the opening degree of the second expansion device 7-2 is increased. It is also possible to determine that the frost melted completely when the pressure keeps rising even after the opening degree of the second expansion device 7-2, performing pressure control of the parallel heat exchanger 50-2 to be defrosted, reaches a predetermined value or more, and the pressure reaches about 10 degrees C. or more on a saturation temperature basis, for example.

Figure 19:
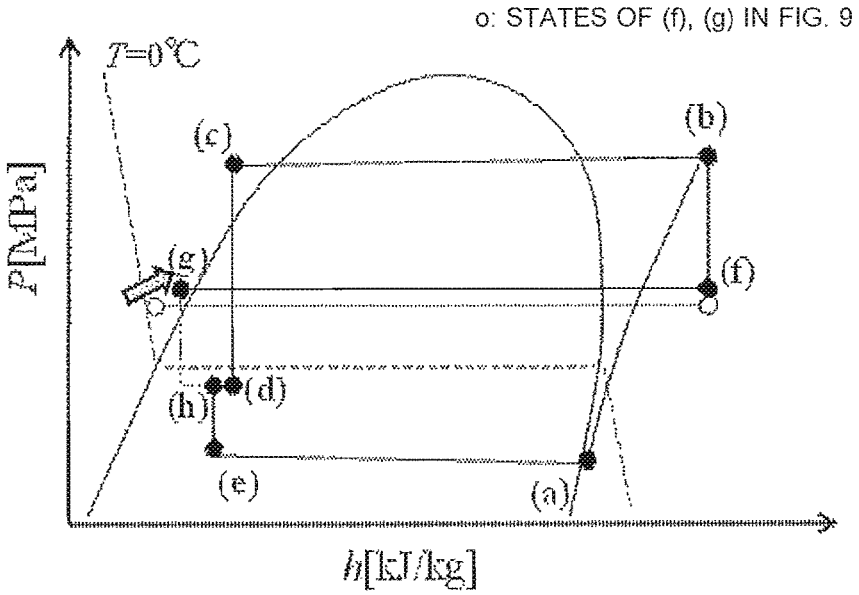
FIG. 19 is a P-h diagram showing behavior of a refrigeration cycle when defrosting has been completed in the heating defrosting operation (FIG. 9), according to Embodiment 1 of the present invention.

FIG. 19 is a P-h diagram showing behavior of a refrigeration cycle when the frost melted completely in the heating defrosting operation shown in FIG. 9, according to Embodiment 1 of the present invention. Description will be given on a phenomenon after the frost melted completely, based on FIGS. 9 and 19 again. As described above, the heat of the refrigerant is conducted to the frost of 0 degrees C. by heat conduction via the heat transfer tube 5*a* and the fin 5*b*, until the frost melted completely. Meanwhile, after the frost has melted completely, as the heat of the refrigerant is conducted to the air by convection, a heat resistance increases. As such, an AK value of the heat exchanger (apparent heat conductivity seen from the refrigerant side in this case, because cooling or heating is not performed) decreases. As heat exchange amount $Q=A\cdot K\cdot \Delta T$, a decrease in the AK value leads to a decrease in the heat exchange amount Q seen from the refrigerant side, or an increase in the temperature difference $\Delta T$. As such, in the parallel heat exchanger 50-2 that continues the defrosting operation after the frost has melted completely, the refrigerant pressure increases to allow $\Delta T$ to increase, and further, the outlet enthalpy increases. Regarding the pressure, as the opening degree of the second expansion device 7-2 is controlled to allow the pressure to be in a predetermined range (a range from 0 degrees C. to 10 degrees C. on a saturation temperature conversion basis), the enthalpy further increases compared with the case of not controlling the opening degree. As such, the subcooling SC at the outlet of the parallel heat exchanger 50-2 largely decreases. Accordingly, it is possible to determine whether or not the frost melted completely based on the change in the subcooling SC at the outlet of the parallel heat exchanger 50-2. Particularly, as it is possible to use, for the determination, a detection by the pressure sensor 21 or other sensors provided for medium-pressure controlling or a state of the second expansion device 7 controlled by a detection by a sensor, the number of sensors can be reduced, which is advantageous.

[Control Procedure]

Figure 20:
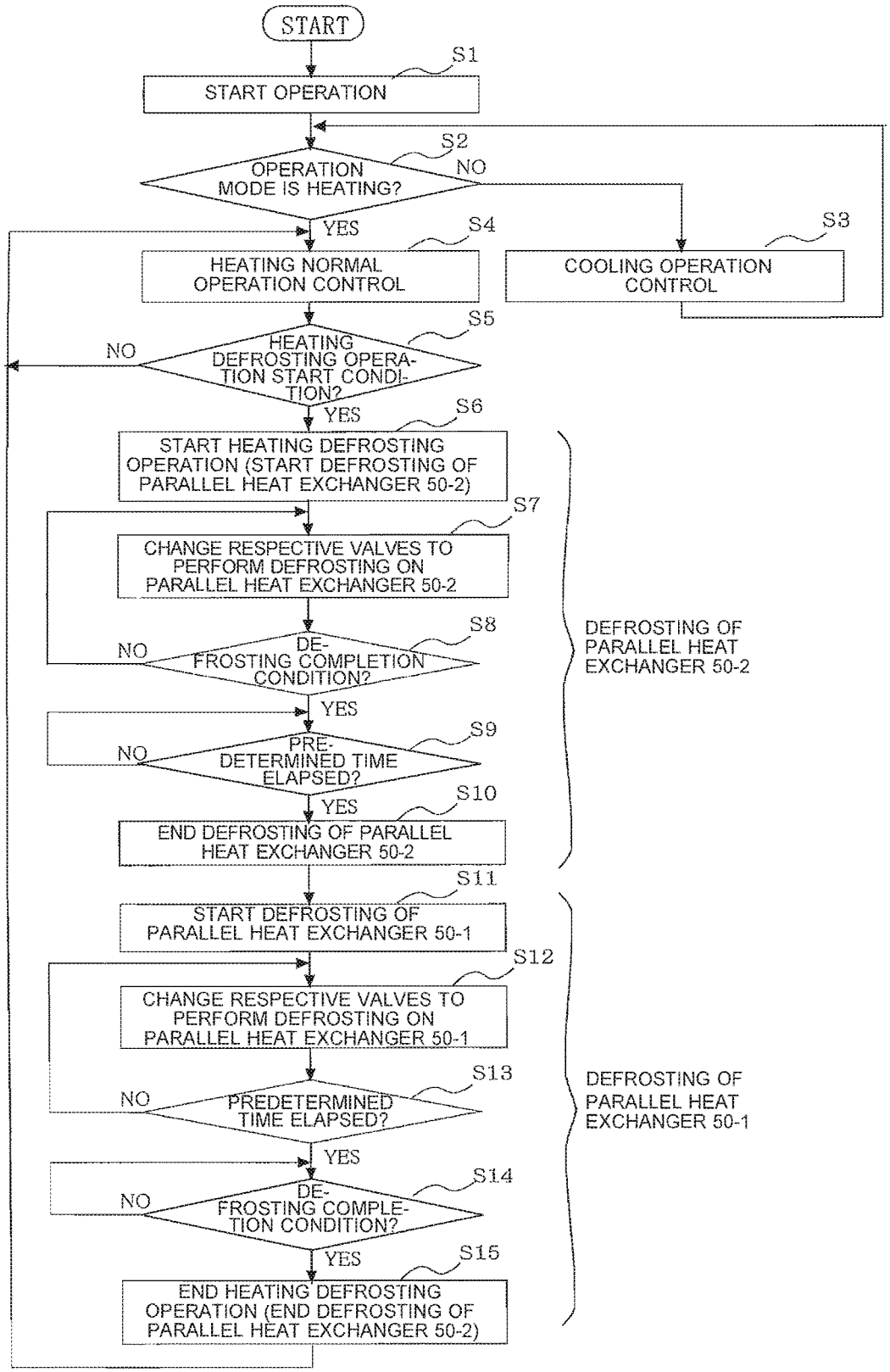
FIG. 20 is a flowchart showing a procedure of controlling the air-conditioning apparatus 100 by a controller 30 according to Embodiment 1 of the present invention.

FIG. 20 is a diagram showing a procedure of controlling the air-conditioning apparatus 100 performed by the controller 30 according to Embodiment 1 of the present invention. When the operation starts (S1), the controller 30 determines whether or not the operation mode of the indoor unit B and C is the heating operation (S2). When it is determined that the operation mode is not the heating operation (it is the cooling operation), control for the normal cooling operation is performed (S3).

Meanwhile, when it is determined that the operation mode is the heating operation, control for the normal heating operation is performed (S4). Then, at the time of heating operation, the controller 30 determines whether or not a defrosting start condition (presence or absence of frosting of a predetermined amount or more) as shown in Expression (1), for example, is satisfied, in consideration of heat conduction by frosting and a drop in heat conductivity of the outdoor heat exchanger 5 due to a decrease in the air volume (S5). Here, x1 may be set to about 10 K to 20 K.

[Expression 1]

$$\text{(saturation temperature of sucked pressure)} < \text{(outside temperature)} - x1 \quad (1)$$

For example, upon determination that the defrosting start condition of Expression 1 or the like is satisfied, for example, the heating defrosting operation is started to defrost the parallel heat exchangers 50-1 and 50-2 alternately (S6). Here, while description will be given on an exemplary control method in the case of sequentially defrosting the parallel heat exchanger 50-2 on the lower side and the parallel heat exchanger 50-1 on the upper side of the outdoor heat exchanger 5 in FIG. 2, the sequence may be opposite.

ON/OFF states of the respective valves in the heating normal operation before entering the heating defrosting operation are in the states shown in the "heating normal operation" column of FIG. 3. Then, from these states, the states of the respective valves are changed to the states of (a) to (e) to start the heating defrosting operation as shown in the "50-1: evaporator 50-2: defrosting" column of "heating defrosting operation" in FIG. 3 (S7).

(a) solenoid valve 8-2 OFF (b) solenoid valve 9-2 ON (c) first expansion device 10 opened (d) second expansion device 7-1 fully opened (e) second expansion device 7-2 start control Until it is determined that a defrosting completion condition that the frost of the parallel heat exchanger 50-2 to be defrosted has melted completely is satisfied, operation to defrost the parallel heat exchanger 50-2 and use the parallel heat exchanger 50-1 as an evaporator is performed (S8). When defrosting is continued and the frost deposited on the parallel heat exchanger 50-2 is melting, the pressure of the parallel heat exchanger 50-2 to be defrosted rises, the subcooling SC at the refrigerant outlet of the parallel heat exchanger 50-2 decreases, and the opening degree of the second expansion device 7-2 increases. As such, a temperature sensor and a pressure sensor may be provided to the first connection pipe 13-2 or the like, for example, and it may be determined that defrosting has been completed when any of Expressions (2) to (5) is satisfied. Here, x2 may be set to about 10 degrees C. on a saturation temperature conversion basis, x3 may be set to about 50% of a maximum opening degree, x4 may be set to about 5 K, and x5 may be set to 2 K.

[Expression 2]

$$(\text{pressure of parallel heat exchanger 50-2 to be defrosted}) > x2 \quad (2)$$

[Expression 3]

$$(\text{opening degree of second expansion device 7-2}) > x3 \quad (3)$$

[Expression 4]

$$(\text{subcooling SC at outlet of parallel heat exchanger 50-2 to be defrosted}) < x4 \quad (4)$$

[Expression 5]

$$(\text{reduced amount from maximum value of subcooling SC at outlet of parallel heat exchanger 50-2 to be defrosted}) < x5 \quad (5)$$

Here, in the defrosting start initial stage (about two to three minutes from the start of defrosting), refrigerant is not stored in the parallel heat exchanger 50-2 to be defrosted, and the subcooling SC at the refrigerant outlet of the parallel heat exchanger 50-2 to be defrosted decreases. Not to erroneously determine this as a decrease in the subcooling SC caused by the frost having melted completely, it is desirable not to perform completion determination based on the subcooling SC at the refrigerant outlet of the parallel heat exchanger 50-2 to be defrosted, until a certain period of time (about two to three minutes) elapses from the beginning of the defrosting.

Further, there is a case where defrosting has not been completed actually even though it is determined that a defrosting completion condition is satisfied, depending on the outside air temperature, air velocity of the outside wind, a frosting state due to snow and wind, and the like. As such, defrosting is set to be continued for a certain period of time (about two to three minutes) even though it is determined that a defrosting completion condition is satisfied, by multiplying a safety factor to melt the frost completely (S9). Thereby, defrosting can be performed completely, which enhances the reliability of the device.

Then, when it is determined that any of Expressions (2) to (5) is satisfied and a predetermined period of time elapses, defrosting of the parallel heat exchanger 50-2 is terminated (S10). When defrosting of the parallel heat exchanger 50-2 is terminated, states of the solenoid valve 9-2 and other valves are changed as shown in (a) to (c) below, and defrosting of the parallel heat exchanger 50-1 is started (S11).

(a) solenoid valve 9-2 OFF (b) solenoid valve 8-2 ON (c) second expansion devices 7-1 and 7-2 normal medium-pressure control At this time, states of the respective valves are changed to those shown in ° ° 50-1: defrosting, 50-2: evaporator of "heating defrosting operation" in FIG. 3 (S12), and defrosting of the parallel heat exchanger 50-1 is started this time. In (S10) to (S13), as for control processing and the like such as success or failure of a defrosting completion condition and termination of defrosting after a lapse of a predetermined period of time, the controller 30 performs processing similar to that of (S6) to (S9) although the valve numbers are different. Then, upon termination of defrosting of the parallel heat exchanger 50-1, the heating defrosting operation is terminated (S15), and control for the normal heating operation is performed (S4).

As described above, in the outdoor heat exchanger 5, root ice can be prevented by defrosting the parallel heat exchanger 50-2 located on the upper side and the parallel heat exchanger 50-1 located on the lower side sequentially.

As described above, according to the air-conditioning apparatus 100 and the outdoor unit A of Embodiment 1, by performing the heating defrosting operation, it is possible to perform heating in the room continuously while performing defrosting on the outdoor heat exchanger 5. At this time, by decompressing part of high-temperature and high-pressure gas refrigerant, branched from the discharge pipe 1*a*, to have a pressure of about 0 degrees C. to 10 degrees C. on a saturation temperature conversion basis that is higher than the temperature of the frost, and allowing it to flow into the parallel heat exchanger 50 to be defrosted, it is possible to perform an efficient operation utilizing the latent heat of condensation of the refrigerant.

Further, as completion of defrosting is determined based on a pressure in the parallel heat exchanger 50 to be defrosted, subcooling SC at the refrigerant outlet of the parallel heat exchanger 50, an opening degree of the second expansion device 7, and the like, it is possible to determine completion of defrosting more accurately in the heating defrosting operation.

Further, as the pressure in the parallel heat exchanger 50 to be defrosted is allowed to be 0 degrees C. to 10 degrees C. on a saturation temperature conversion basis, it is possible to distribute the refrigerant amount, refrigerant temperature, and the like for defrosting appropriately, and to maintain the heating capability.

Further, as a defrosting completion condition is not determined for a certain period of time after starting defrosting during which the subcooling is small, for example, it is possible to prevent erroneous determination of completion of defrosting. Further, as defrosting is continued for a certain period of time after it is determined that defrosting is completed, even if uneven defrosting is caused by unevenness in the wind velocity or the like and it is determined that defrosting is completed although the frost has not melted completely in the parallel heat exchanger 50, for example, by allowing the defrosting to be continued, it is possible to melt the frost completely.

Embodiment 2

Figure 21:
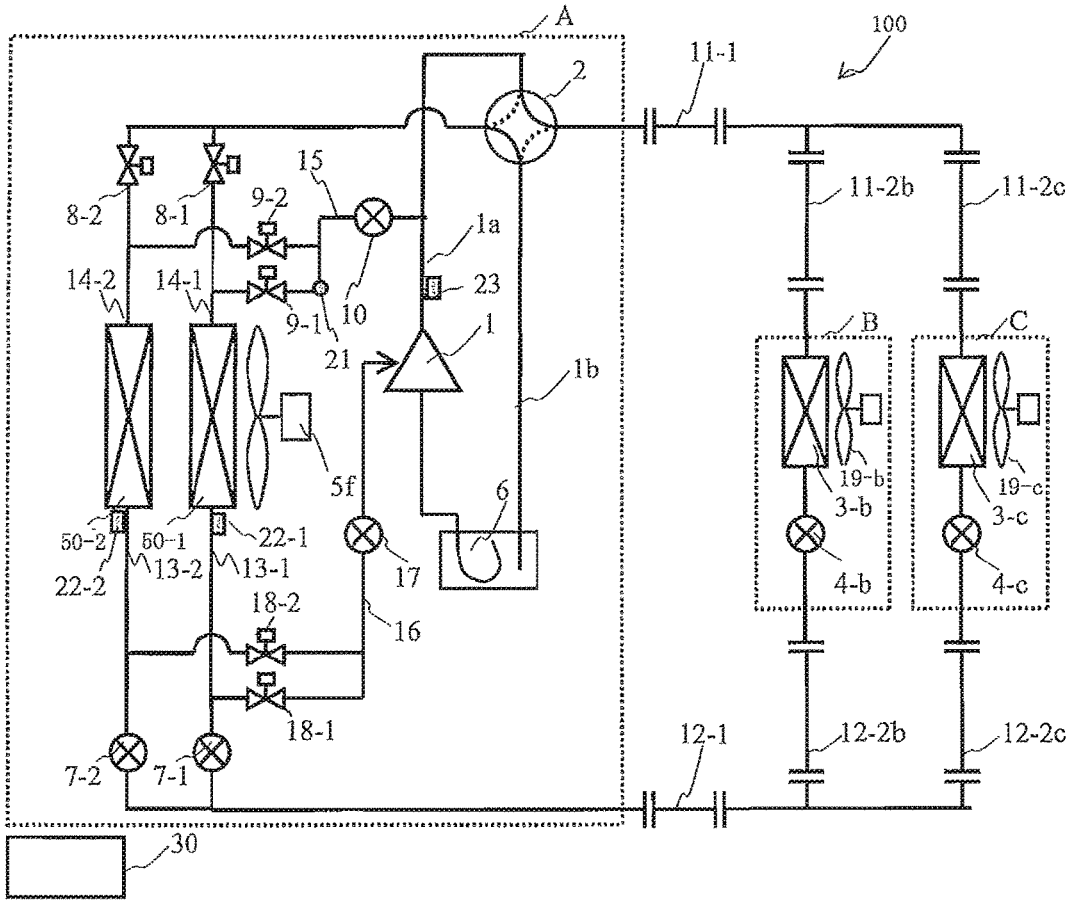
FIG. 21 is a diagram showing a configuration of an air-conditioning apparatus 100 according to Embodiment 2 of the present invention.

FIG. 21 is a diagram showing a configuration of an air-conditioning apparatus 100 according to Embodiment 2 of the present invention. In FIG. 21, devices and the like denoted by the same reference numerals or characters perform operations similar to that described in Embodiment 1. Hereinafter, description will be given mainly on the aspects of an air-conditioning apparatus 100 of Embodiment 2 that are different from the aspects of the air-conditioning apparatus 100 of Embodiment 1.

In the air-conditioning apparatus 100 according to Embodiment 2, a compressor 1 includes an injection port from which refrigerant can be introduced (injected) from the outside of the compressor 1 to a compression chamber for compressing the refrigerant in the compressor 1.

Further, an outdoor unit A of the air-conditioning apparatus 100 of Embodiment 2 includes a second defrosting pipe 16 for injecting refrigerant, having passed through the parallel heat exchanger 50 to be defrosted, into the compressor 1 in the heating operation. The second defrosting pipe 16 is configured such that one end thereof is connected with the injection port of the compressor 1. Further, the other end thereof is branched, and the branched ends each are connected with first connection pipes 13-1 and 13-2.

Further, the second defrosting pipe 16 is provided with a third expansion device 17. The third expansion device 17 decompresses refrigerant flowing into the second defrosting pipe 16. The decompressed refrigerant flows to the compressor 1. The third expansion device 17 is a valve in which the opening degree is variable, and is configured of an electronic expansion valve or the like, for example. Further, in the second defrosting pipe 16, the branched pipes each are provided with third solenoid valves 18-1 and 18-2, respectively. The third solenoid valves 18-1 and 18-2 control whether or not to inject the refrigerant, flowing in the second defrosting pipe 16, into the compressor 1. In this example, as the third solenoid valves 18-1 and 18-2, any types of valves can be used if they are able to control a flow of refrigerant such as a four-way valve, a three-way valve, and a two-way valve. Further, a discharge pipe 1*a* of the compressor 1 is provided with a temperature sensor 23.

FIG. 22 is a diagram showing ON/OFF states of the respective valves and states of opening degree adjusting control in the respective operation modes of the air-conditioning apparatus 100 according to Embodiment 2 of the present invention. In FIG. 22, states of the third expansion device 17 and the solenoid valves 18-1 and 18-2 are added to FIG. 3.

The solenoid valve 18-1 is turned ON when the parallel heat exchanger 50-1 becomes a target of defrosting. Further, the solenoid valve 18-2 is turned ON when the parallel heat exchanger 50-2 becomes a target of defrosting. Then, they inject the refrigerant, after defrosting, into the compressor 1. At this time, the controller 30 controls the opening degree of the third expansion device 17 based on a rise in the discharge temperature of the compressor 1 or a rise in the discharge superheat SH to control the injection flow rate.

In the heating defrosting operation (continuous heating operation) in which the parallel heat exchanger 50-1 becomes a target of defrosting, when the frost has melted completely, subcooling SC on the refrigerant outlet side of the parallel heat exchanger 50-1 to be defrosted decreases and the enthalpy increases. Further, in the heating defrosting operation (continuous heating operation) in which the parallel heat exchanger 50-2 becomes a target of defrosting, when the frost has melted completely, subcooling SC on the refrigerant outlet side of the parallel heat exchanger 50-2 to be defrosted decreases and the enthalpy increases. As such, enthalpy of the refrigerant discharged by the compressor 1 also increases, and the discharge temperature rises. At this time, as the discharge temperature rises by being amplified corresponding to a refrigerant compression ratio and a specific heat ratio, the refrigerant flowing out of the parallel heat exchanger 50 to be defrosted is allowed to be injected into the compressor 1, and by determining whether or not the discharge temperature is changed abruptly, it is possible to determine whether or not the frost has melted completely. For example, in the control flow S8 of the controller 30 described in Embodiment 1, determination represented by Expression (6) can be added. Here, x6 may be set to 5 degrees C.

[Expression 6]

$$\text{(variation from previous measurement value of discharge temperature or discharge superheat of compressor 1)} > x6 \quad (6)$$

As described above, according to the air-conditioning apparatus 100 of Embodiment 2, when injecting the refrigerant cooled by defrosting into the compressor 1, the controller 30 performs defrosting completion determination based on a rise in the discharge temperature of the compressor 1. As such, it is possible to accurately determine a rise in the refrigerant temperature due to a decrease in subcooling of the parallel heat exchanger 50, and to perform determination of whether or not defrosting is completed in a short period of time with high accuracy.

Embodiment 3

In Embodiment 1 and Embodiment 2 described above, description has been given on exemplary configurations in which the outdoor heat exchanger 5 is divided into a plurality of parallel heat exchangers 50-1 and 50-2. However, the present invention is not limited to this configuration. For example, a configuration having a plurality of independent outdoor heat exchangers 5, connected in parallel with each other, may be acceptable. It is possible to perform the heating defrosting operation in which a part of the outdoor heat exchanger 5 is set to be a target of defrosting and the rest of the outdoor heat exchanger 5 continues the heating operation.

INDUSTRIAL APPLICABILITY

Further, while the air-conditioning apparatus 100 has been described as an example of a refrigeration cycle apparatus in the embodiments described above, the present invention is not limited to this configuration. For example, the present invention is applicable to other refrigeration cycle apparatus such as a refrigerating device and a freezer, for example.

REFERENCE SIGNS LIST

1 compressor 1*a* discharge pipe 1*b* suction pipe 2 cooling/heating switching device (four-way valve) 3-*b*, 3-*c* indoor heat exchanger 4-*b*, 4-*c* flow rate control device 5 outdoor heat exchanger 5*a* heat transfer tube 5*b* fin 5*f* outdoor fan 6 accumulator 7-1, 7-2 second expansion device 8-1, 8-2, 8-3, 9-1, 9-2 solenoid valve 10 first expansion device 11-1, 11-2*b*, 11-2*c* first extension pipe 12-1, 12-2*b*, 12-2*c* second extension pipe 13-1, 13-2 first connection pipe 14-1, 14-2 second connection pipe 15 first defrosting pipe 16 second defrosting pipe 17 third expansion device 18-1, 18-2 solenoid valve 19-*b*, 19-*c* indoor fan 21 pressure sensor 22-1, 22-2, 23 temperature sensor 30 controller 50-1, 50-2 parallel heat exchanger 100 air-conditioning apparatus A outdoor unit B, C indoor unit.

The invention claimed is:

1. A heat source side unit connected with a use side unit by piping to constitute a refrigerant circuit, the heat source side unit comprising:

a compressor configured to compress and discharge refrigerant;

a plurality of heat source side heat exchangers configured to exchange heat between air and the refrigerant;

a first defrosting pipe serving as a flow path for branching a part of the refrigerant discharged by the compressor and allowing the refrigerant to flow into a heat source side heat exchanger to be defrosted of the plurality of heat source side heat exchangers for defrosting;

a first expansion device configured to decompress the refrigerant passing through the first defrosting pipe;

a second expansion device configured to regulate a pressure of the refrigerant of the heat source side heat exchanger to be defrosted; and a controller configured to control the first expansion device to decompress the pressure of the refrigerant flowing into the heat source side heat exchanger to be defrosted, to regulate the second expansion device to allow the pressure of the refrigerant that passed through the heat source side heat exchanger to be defrosted to fall within a predetermined range, and to perform defrosting completion determination based on a degree of subcooling of the refrigerant on a refrigerant outflow side of the heat source side heat exchanger to be defrosted.

2. The heat source side unit of claim 1, wherein during defrosting, the second expansion device allows the pressure of the refrigerant flowing out of the heat source side heat exchanger to be defrosted to fall within a range from higher than 0 degrees C. to 10 degrees C. on a saturation temperature conversion basis.

3. The heat source side unit of claim 1, wherein the controller determines that defrosting is completed when the controller determines that the degree of subcooling of the refrigerant on the outflow side of the heat source side heat exchanger to be defrosted reaches a predetermined value.

4. The heat source side unit of claim 1, wherein the controller determines that the defrosting is completed when the degree of subcooling of the refrigerant on the refrigerant outflow side begins to decrease after the degree of subcooling of the refrigerant on the refrigerant outflow side rises during defrosting.

5. The heat source side unit of claim 4, wherein the controller determines that defrosting is completed when the controller deter mines that the degree of subcooling of the refrigerant on the refrigerant outflow side decreases from a maximum value of the degree of subcooling during defrosting by a predetermined value or more.

* * * * *